US010512348B2

(12) United States Patent
Vara

(10) Patent No.: US 10,512,348 B2
(45) Date of Patent: Dec. 24, 2019

(54) ARTICLE FOR USE AS SLEEVE OR COASTER WITH A BEVERAGE CONTAINER

(71) Applicant: James E. Vara, Garland, TX (US)

(72) Inventor: James E. Vara, Garland, TX (US)

( * ) Notice: Subject to any disclaimer, the term of this patent is extended or adjusted under 35 U.S.C. 154(b) by 199 days.

(21) Appl. No.: 15/397,378

(22) Filed: Jan. 3, 2017

(65) Prior Publication Data

US 2017/0156527 A1 Jun. 8, 2017

Related U.S. Application Data

(63) Continuation-in-part of application No. 14/248,623, filed on Apr. 9, 2014, now Pat. No. 9,533,794.

(51) Int. Cl.

| | |
|---|---|
| ***A47G 23/02*** | (2006.01) |
| ***B65D 81/38*** | (2006.01) |
| ***A47G 23/03*** | (2006.01) |
| ***A47G 23/032*** | (2006.01) |
| ***B65D 23/08*** | (2006.01) |

(52) U.S. Cl.

CPC ..... *A47G 23/0241* (2013.01); *A47G 23/0266* (2013.01); *A47G 23/032* (2013.01); *A47G 23/0306* (2013.01); *A47G 23/0313* (2013.01); *A47G 23/0316* (2013.01); *B65D 23/085* (2013.01); *B65D 81/3876* (2013.01); *A47G 2023/0275* (2013.01)

(58) Field of Classification Search

CPC ..... A47G 23/0241; A47G 23/0266; A47G 23/0313; A47G 23/0316; A47G 23/0306; A47G 23/032; A47G 23/058; A47G 23/0216; A47G 2023/0275; B65D 81/3876; B65D 6/40; A45C 11/18; G09F 3/20; G09F 3/18

USPC ..... 220/737

See application file for complete search history.

(56) References Cited

U.S. PATENT DOCUMENTS

| | | | | |
|---|---|---|---|---|
| 4,324,058 A * | 4/1982 | Sherwick | G09F 3/0288 | 40/306 |
| 5,427,254 A * | 6/1995 | Knieriem | B42D 5/005 | 211/50 |
| 6,257,485 B1 * | 7/2001 | Sadlier | B65D 3/22 | 229/198.2 |
| 6,264,032 B1 * | 7/2001 | Hobbs | E04H 13/003 | 206/449 |

(Continued)

*Primary Examiner* — Anthony D Stashick
*Assistant Examiner* — James M Van Buskirk
(74) *Attorney, Agent, or Firm* — Schultz & Associates, P.C.

(57) ABSTRACT

An article that can be formed into a sleeve or a coaster for a beverage container. The article includes: (a) a first sheet that is at least sufficiently flexible to be wrapped around the cylindrical body of the beverage container to position an inner surface of an end portion of the first sheet adjacent an outer surface of a tab portion of the first sheet to form an overlapping area between the end portion and the tab portion; (b) a first adhesive on a first portion of an inner surface of the first sheet, wherein the first portion is at least partially within the overlapping area; and (c) a second adhesive on a second portion of the inner surface of the first sheet, wherein the second portion is at least partially outside the overlapping area, and wherein the first adhesive and the second adhesive can be the same or different.

13 Claims, 10 Drawing Sheets

(56) References Cited

U.S. PATENT DOCUMENTS

| | | | | |
|---|---|---|---|---|
| 7,000,801 | B2 * | 2/2006 | Rodriguez | B65D 25/36 220/737 |
| 8,834,678 | B2 * | 9/2014 | Druecke | D21H 17/29 162/111 |
| 9,907,421 | B2 * | 3/2018 | Carson | A47G 23/02 |
| 2008/0203105 | A1 * | 8/2008 | Trotman | B65D 75/525 220/737 |

* cited by examiner

ARTICLE FOR USE AS SLEEVE OR COASTER WITH A BEVERAGE CONTAINER

CROSS-REFERENCE TO RELATED APPLICATIONS

This application is a continuation-in-part of application Ser. No. 14/248,623, filed on Apr. 9, 2014. The patent application identified above is incorporated here by reference in its entirety to provide continuity of disclosure.

FIELD OF THE INVENTION

The disclosure is in the fields of sleeves and coasters for use with beverage containers such as bottles or cans.

BACKGROUND AND SUMMARY OF THE INVENTION

In general, the disclosure provides an article that can be formed into a sleeve or a coaster for a beverage container. A beverage container has a generally cylindrical body. The article includes: (a) a first sheet, wherein the first sheet has an outer surface and an inner surface, wherein the first sheet is at least sufficiently flexible to be longitudinally wrapped around the generally cylindrical body of the beverage container to position an inner surface of an end portion of the first sheet adjacent an outer surface of a tab portion of the first sheet to form an overlapping area between the end portion and the tab portion; (b) a first adhesive on a first portion of an inner surface of the first sheet, wherein the first portion is at least partially within the overlapping area; and (c) a second adhesive on a second portion of the inner surface of the first sheet, wherein the second portion is at least partially outside the overlapping area, and wherein the first adhesive and the second adhesive can be the same or different.

In an embodiment, the disclosure provides an article according to the disclosure in combination with the beverage container. In various embodiments, such an article is wrapped as a sleeve for the beverage container. In various embodiments, such an article is flattened as a coaster for the beverage container. The beverage container can be, for example, a beverage bottle or beverage can.

In another embodiment, the disclosure provides an article according to the disclosure in combination with a dispenser. In various embodiments, such an article is one of a plurality of such articles in the dispenser. In various embodiments, such an article is disposed in the dispenser in a flat condition without being curled or folded. In various embodiments, the dispenser is in the general form of a tray.

In yet another embodiment, the disclosure provides an article according to the disclosure in combination with a dispenser and the beverage container.

In various embodiments, methods of using the article according to various embodiments of the disclosure are provided, the methods comprising steps of: (a) wrapping the article around the generally cylindrical body of the beverage container to position an inner surface of an end portion adjacent an outer surface of a tab portion to form the overlapping area between the end portion and the tab portion; (b) using the first adhesive to adhere the end portion and tab portion of the overlapping area.

In various embodiments, methods of using the article according to various embodiments of the disclosure are provided, the methods of comprising steps of: (a) curving the article into a cylindrical shape to position an inner surface of an end portion adjacent an outer surface of a tab portion to form the overlapping area between the end portion and the tab portion; (b) using the first adhesive to adhere the end portion and tab portion of the overlapping area. In various embodiments, the methods additionally comprise a step of: flattening the article in the form of a sleeve by forming two fold lines in the first sheet material and thereby forming the article into a folded and flattened condition as a coaster that can be used under the beverage container. In various embodiments, the methods additionally comprise a step of: positioning the coaster under the beverage container.

In various embodiments, methods of using the article according to various embodiments of the disclosure are provided, the methods comprising steps of: folding the first sheet about in half forming one fold in the first sheet material with the inner surfaces of the end portion and tab portion of the first sheet adjacent to each other into a folded and flattened condition as a coaster that can be used under the beverage container. In various embodiments, the methods additionally comprise a step of: positioning the coaster under the beverage container. In various embodiments, the methods additionally comprise a step of: using the second adhesive on the second portion of the inner surface of the first sheet to adhere to an opposite portion of the inner surface of the first sheet to help prevent the flattened article from bulging or popping open from the folded and flattened condition as a coaster.

These and other embodiments of the disclosure will be apparent to one skilled in the art upon reading the following detailed description. While the disclosure is susceptible to various modifications and alternative forms, specific embodiments thereof will be described in detail and shown by way of example. It should be understood, however, that it is not intended to limit the disclosure to the particular forms disclosed.

BRIEF DESCRIPTION OF THE DRAWINGS

The accompanying drawing is incorporated into the specification to help illustrate examples according to a presently preferred embodiment of the disclosure. Like references are used for like parts, elements, or features throughout the figures. It should be understood that the Figures of the drawing are not necessarily to scale.

In FIG. 13A, the dispenser is shown empty. In FIG. 13B, the dispenser is shown containing a stack of a plurality of articles of FIGS. 1-2.

In FIG. 14A, the dispenser is shown empty. In FIG. 14B, the dispenser is shown containing a stack of a plurality of articles of FIGS. 1-2.

DETAILED DESCRIPTION OF THE PREFERRED EMBODIMENT

Definitions and Usages

General Interpretation

Figure 1:
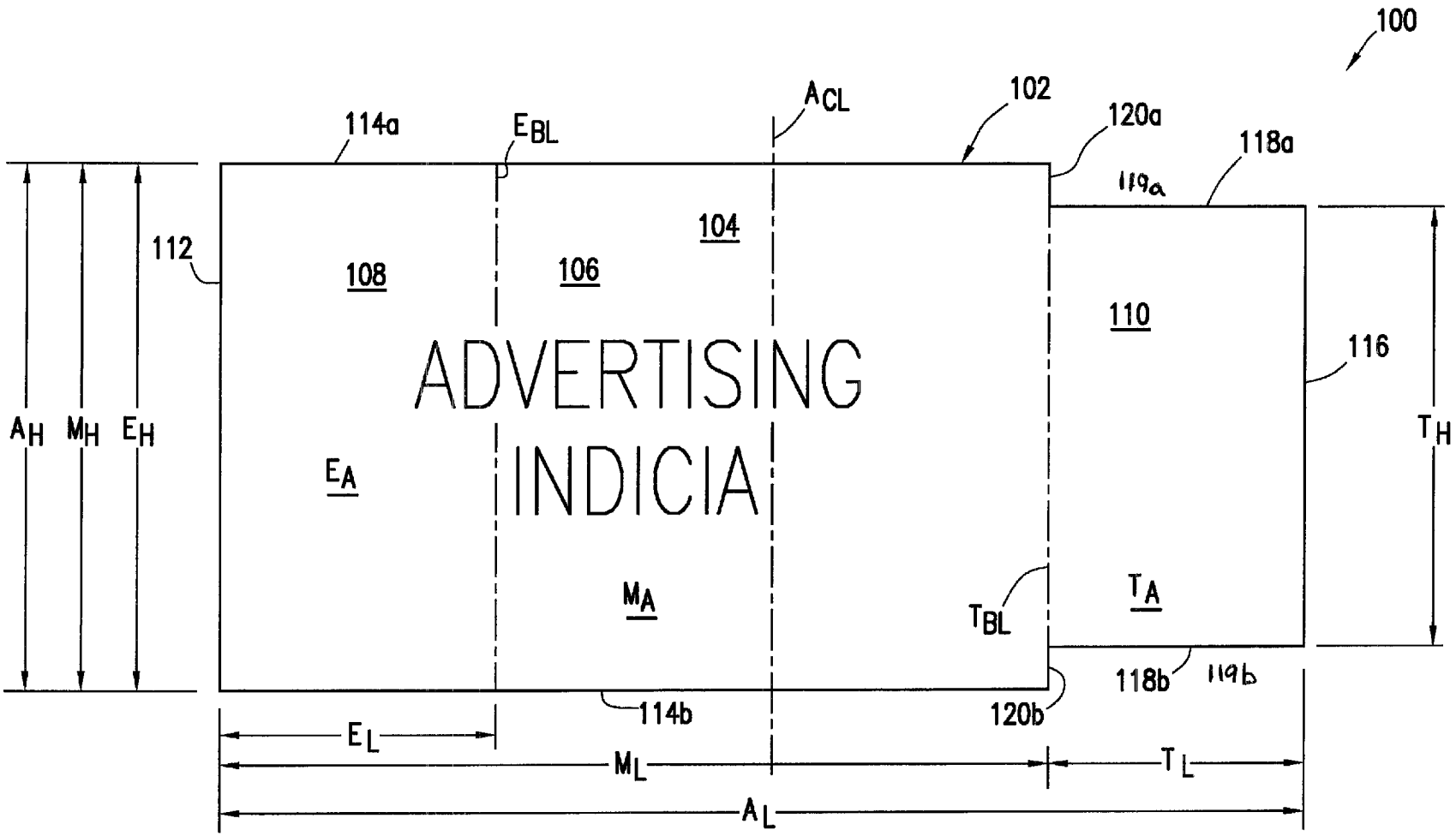
FIG. 1 is a view of an embodiment of an article according to the disclosure, showing the article in a flat, unfolded position. The article is of at least a first sheet. The first sheet of the article has a major portion, which includes an end portion (on left side of the article as illustrated in FIG. 1), and the first sheet also has a tab portion, which is outside of the major portion (on right side of the article as illustrated in FIG. 1). An outer surface of the first sheet of the article can optionally have advertising or other indicia printed thereon.

The words or terms used herein have their plain, ordinary meaning in the field of this disclosure, except to the extent explicitly and clearly defined in this disclosure or unless the specific context otherwise requires a different meaning.

If there is any conflict in the usages of a word or term in this disclosure and one or more patent(s) or other documents that may be incorporated by reference, the definitions that are consistent with this specification should be adopted.

The words "comprising", "containing", "including", "having", and all grammatical variations thereof are intended to have an open, non-limiting meaning. For example, a composition comprising a component does not exclude it from having additional components, an apparatus comprising a part does not exclude it from having additional parts, and a method having a step does not exclude it having additional steps. When such terms are used, the compositions, apparatuses, and methods that "consist essentially of" or "consist of" the specified components, parts, and steps are specifically included and disclosed. As used herein, the words "consistently essentially of," and all grammatical variations thereof are intended to limit the scope of a claim to the specified materials or steps and those that do not materially affect the basic and novel characteristic(s) of the claimed invention.

The indefinite articles "a" or "an" mean one or more than one of the component, part, or step that the article introduces.

Each numerical value should be read once as modified by the term "about" (unless already expressly so modified), and then read again as not so modified, unless otherwise indicated in context.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values.

It should be understood that algebraic variables and other scientific symbols used herein are selected arbitrarily or according to convention. Other algebraic variables can be used.

Terms such as "first," "second," "third," etc. may be assigned arbitrarily and are merely intended to differentiate between two or more components, parts, or steps that are otherwise similar or corresponding in nature, structure, function, or action. For example, the words "first" and "second" serve no other purpose and are not part of the name or description of the following name or descriptive terms. The mere use of the term "first" does not require that there be any "second" similar or corresponding component, part, or step. Similarly, the mere use of the word "second" does not require that there be any "first" or "third" similar or corresponding component, part, or step. Further, it is to be understood that the mere use of the term "first" does not require that the element or step be the very first in any sequence, but merely that it is at least one of the elements or steps. Similarly, the mere use of the terms "first" and "second" does not necessarily require any sequence. Accordingly, the mere use of such terms does not exclude intervening elements or steps between the "first" and "second" elements or steps, etc.

The control or controlling of a condition includes any one or more of maintaining, applying, or varying of the condition. For example, controlling the temperature of a substance can include heating, cooling, or thermally insulating the substance.

Liquid

"Liquid" (noun) means a substance that is liquid at standard temperature and pressure.

"Liquid" (adjective) regarding a substance means existing as or having characteristics of a liquid; especially tending to flow.

Standard Temperature and Pressure

"Standard" (adjective) regarding temperature means about 21° C. (about 70° F.).

"Standard" (adjective) regarding pressure means about one atmosphere (about 101,325 Pascal).

Beverages

"Beverage" (noun) or "drink" (noun) means any liquid suitable for drinking. Examples of beverages include water, soda, beer, wine, milk, tea, and coffee.

Room Temperature as Serving Temperature

"Room temperature" (adjective phrase) regarding serving temperature for a beverage means in the range of about 16-27° C. (about 61-81° F.), that is, standard temperature plus or minus about 5° C. (about 10° F.).

Cold Beverages and Serving Temperatures

"Cold" (adjective) regarding a beverage means a type of beverage typically served at or below room temperature. Examples of cold beverages include water, soda, beer, iced tea, wine, milk, and milkshakes.

"Very cold" (adjective phrase) regarding serving temperature for a cold beverage is in the range of about 0-4° C. (about 32-39° F.).

"Cold" (adjective) regarding serving temperature for a cold beverage is in the range of about 4-7° C. (about 39-45° F.).

"Cool" (adjective) regarding serving temperature for a cold beverage is in the range of about 8-12° C. (about 45-54° F.).

"Cellar" (adjective) regarding serving temperature for a cold beverage is in the range of about 12-14° C. (about 54-57° F.).

"Warm" (adjective) regarding serving temperature for a cold beverage is in the range of about 14-16° C. (about 57-61° F.).

Hot Beverages and Serving Temperatures

"Hot" (adjective) regarding a beverage means a type of beverage typically served above room temperature up to a maximum of about 88° C. (190° F.). Examples of hot beverages include coffee, tea, and hot chocolate.

"Warm" (adjective) regarding serving temperature for a hot beverage is in the range of about 27-50° C. (about 81-120° F.).

"Hot" (adjective) regarding serving temperature for a hot beverage is in the range of about 50-71° C. (about 120-160° F.).

"Very hot" (adjective phrase) regarding serving temperature for a hot beverage is in the range of about 71-85° C. (about 160-185° F.).

"Scalding" (adjective) regarding serving temperature for a hot beverage means above about 55° C. (about 130° F.).

Beverage Containers

"Container" (noun) means an object that can be used to hold things.

"Vessel" (noun) means an object used as a container, especially for liquids.

"Beverage container" (noun phrase) means a container for a beverage. Unless otherwise specified, a beverage container has a generally cylindrical body. Examples of a beverage container include a bottle or a can.

"Bottle" (noun) means a glass or plastic vessel having a body portion (belly) with a narrow neck and no handle on the body portion. In the context of this disclosure, a beverage bottle is sometimes referred to simply as a bottle. Unless otherwise specified, a bottle for a beverage has a generally cylindrical body. Examples of a beverage bottle include water bottle, beer bottle, soda bottle, and wine bottle. A bottle can be made of glass, plastic, or metal.

"Can" (noun) means an airtight sealed metal container for food or drink or paint. Unless otherwise specified, a beverage can for a beverage can be a generally cylindrical body. In the context of this disclosure, a beverage can is sometimes referred to simply as a can. Examples of a beverage can include a beer can and a soda can.

"Individual serving size" (adjective phrase) for a beverage or beverage container means broadly in the range of about 6-20 US fluid ounces (about 177-592 ml), but more commonly in the range of about 8-17 US fluid ounces (about 237-502 ml). In the United States, 12 fluid ounces (355 ml) is currently a typical individual serving size for a beverage bottle or can.

Particular dimensions of beverage bottles can vary widely. "US standard size" (adjective phrase) regarding a beverage bottle means having a generally cylindrical body that has a diameter of about 2.41 inches (6.1 cm) and a height of about 9.1 inches (23.1 cm), with a label panel height (of the largest cylindrical body portion) of about 3.4 inches (8.9 cm).

"US standard size" (adjective phrase) regarding a beverage can means having a generally cylindrical body that is 4.83 inches (12.3 cm) high, 2.13 inches (5.4 cm) in diameter at the lid, and 2.60 inches (6.6 cm) in diameter at the largest circumference of the cylindrical body.

Condensation

Depending on the context, "condensation" (noun) means the process of changing from a gaseous to a liquid or solid state.

Depending on the context, "condensation" or "condensate" (noun) means atmospheric moisture that has condensed because of cold.

Absorbency

"Absorb" (verb) means to soak up liquids.

"Absorbent" (adjective) or "absorbency" (adverb) means having power, capacity, or tendency to absorb or soak up a liquid, such as water.

"Water absorbency" (adjective phrase) means the quantitative capacity of a material to absorb water. As used herein, water absorbency (also known as "Water absorptiveness" or "Cobb value") is the mass of water absorbed in a specific time by square meter of the sheet material under standardized test conditions. It can be measured according to the standards set by TAPPI (Technical Association of the Pulp and Paper Industry), Method T-432. It is normally expressed as time, in seconds.

Examples of absorbent paper materials include paper napkins, paper towels, blotting paper, etc.

Insulate and Insulation

"Insulate" (verb) to means to protect something by surrounding it with material that reduces or prevents the transmission of heat.

Depending on the context, "insulation" (noun) means a material that reduces or prevents the transmission of heat.

Depending on the context, "insulation" (noun) means the act of protecting something by surrounding it with material that reduces or prevents the transmission of heat.

Coasters, Sleeves, and Dispensers

"Coaster" (noun) means a covering (plate or mat) that protects the surface of a table or counter from the heat of a beverage container at a hot or very hot serving temperature or from the condensation that may form on a beverage container at a cold or very cold serving temperature. A coaster can protect a surface from any spillage from the beverage container. A coaster may have either or both the purposes of insulating a surface or counter and water absorbency.

"Sleeve" (noun) means an article having a generally tubular shape and likable to the part of a garment that is attached at armhole and provides a cloth covering for the arm. A sleeve for use with a beverage container can protect a person's bare hand from the heat of a beverage container at a hot or very hot serving temperature or from the cold and condensation that may form on a beverage container at a cold or very cold serving temperature. Depending on the water absorbency of the materials of the sleeve, a sleeve can protect a bare hand from becoming wet with the condensation and absorb any small leak or spillage from the opening of the beverage container. A sleeve can have either or both the purposes of insulating a surface or counter and water absorbency.

"Dispenser" (noun) means a container so designed that the contents can be used in prescribed amounts, for example, one article at a time.

"Tray" (noun) means an open receptacle for holding or displaying or serving articles.

Relative Location or Orientation

"Surface" (noun) means the extended two-dimensional outer boundary of a three-dimensional object.

"Inner" (adjective) means located inward (or within or closer to a center or inside of a body).

"Outer" (adjective) means located outward (outside of or away from a center or inside of a body).

"Horizontal" (adjective) or "horizontally" (adverb) means parallel to or in the plane of the horizon [on earth] or a base line.

"Vertical" (adjective) or "vertically" (adverb) means at right angles to the plane of the horizon [on earth] or a base line.

"Longitudinal" (adjective) or "longitudinally" (adverb) means running lengthwise.

Sheet Material

"Material" (noun) means the tangible substance that goes into the makeup of a physical object.

"Sheet" (noun) means a flat article that is thin relative to its length and width.

"Thin" (adjective) means of relatively small extent from one surface to the opposite or in cross-section.

"Edge" (noun) means the boundary of a surface. It is usually, but not necessarily, a line determining the limits of an area.

"Deckle" (adjective) regarding an edge means the rough edges on hand made and machine made papers or other sheet materials. These edges were originally considered an imperfection, but came into fashion with the handcraft revival in the last decade of the $19^{th}$ century.

"Area" (adjective) regarding a whole sheet means the extent of the 2-dimensional surface of the sheet bounded within its dimensions of length and width.

"Flexible" (adjective) means capable of being easily flexed or bent by hand. More particularly, as used herein, "flexible" means able to be flexed or bent up to at least a 90-degree angle in at least one orientation without creasing or breaking. If specified, flexible can mean able to be flexed or bent up to at least 90-degree angle in any orientation.

"Structural" (adjective) means affecting or involved in structure or construction. More particularly, a structural sheet, when formed into a tubular or sleeve shape of a size for being wrapped around a U.S. standard beverage container can be self-supporting when stood on a flat surface in a vertically orientated position. Preferably, a structural body (such as a sheet of paper) can be vertically self-supporting when flat and stood on a longer or longest end in a vertical position.

Types and Properties of Sheet Materials

"Paper" (noun) or "paper" (adjective) means sheet material made of cellulose pulp derived mainly from wood or rags or certain grasses.

"Plastic" (adjective) regarding the substance of a material is a generic name for certain synthetic or semisynthetic materials that can be molded or extruded into objects or films or filaments or used for making, for example, a coating. Plastic materials that may be used for a sheet material include various polymeric materials such as acrylic, polystyrene, polycarbonate, polyester, and polyvinyl (sometimes referred to simply as vinyl).

Plastic sheet materials are generally stronger than paper sheet materials. In general, physical properties are provided herein measured according to the standard testing methods strengths of TAPPI (Technical Association of the Pulp and Paper Industry), which are generally directed to paper sheet materials; however, as plastic sheet materials are generally stronger than paper, it is expected that a plastic sheet material of similar weight and thickness to a paper sheet material would generally exceed the strengths of the paper sheet material. The strengths of sheet materials may be expressed as exemplary, desired, or preferred minimums without need for specifying the upper limits. Testing methods for paper can usually be adapted to test other types of sheet materials, such as plastic materials, although the testing method may only show that the other type of material has at least the specified strength without actually measuring the higher strength at a failure of the material. The disadvantages of certain plastic materials relative to paper materials can be, for example, but not necessarily, cost and less biodegradability.

"Caliper" or thickness (noun) indicates the thickness of a paper or other sheet material, usually in thousandths of an inch. As used herein, caliper or thickness is measured according to the standards set by TAPPI (Technical Association of the Pulp and Paper Industry), Method T-411.

The "weight" or "grammage" (noun) of a paper or other sheet material is the weight per unit area, which can be expressed, for example, in grams per square meter ($g/m^2$, sometimes referred to as "GSM"). This measure is continuous, meaning that all categories and sizes of paper or other sheet material can use the measure. As used herein, weight or grammage of a paper sheet material is measured according to the standards set by the TAPPI (Technical Association of the Pulp and Paper Industry), Method T-410.

"Text" (adjective) regarding paper means relatively lightweight paper for use as the pages of books. Text paper typically has a weight in the range of about 50-250 GSM using TAPPI Method T-410.

"Writing" (adjective) or "bond" (adjective) regarding paper means the kind of quality paper commonly used legal documents. Writing paper typically has a weight in the range of about 75-150 GSM using TAPPI Method T-410.

"Bristol" (adjective) regarding paper means made by pasting or laminating two text weight papers together to form a stiff cover sheet.

"Cover" or "card" (adjective) regarding paper means heavyweight paper with good folding characteristics. Cover papers are relatively heavy and strong. Their diverse uses include for covers, folders, booklet covers, brochures, pamphlets, and business cards. Cover paper typically has a weight in the range of about 100-500 GSM using TAPPI Method T-410.

"Industrial" or "packaging" grades of paper can have similar or higher weights compared to writing and card papers.

"Paperboard" normally refers to sheets of paper 0.012 inch (0.3 mm) or more in thickness. There are some exceptions such as in the case of blotting paper or drawing paper. Broad classes of paperboard include, for example, container board used for corrugated boxes and box board principally used to make cartons.

"Uncoated" (adjective) regarding paper means paper manufactured with no surface coating. There is a wide variety of grades and levels of quality among uncoated papers.

"Coated" (adjective) regarding paper means paper made with a surface coating, which allows for maximum smoothness and ink holdout in the printing process. Coating is the treatment of the paper surface with clay or other pigments or adhesives to enhance printing quality, color, smoothness, opacity, or other surface characteristics. Coated papers are available in a range of finishes from dull to matte and gloss.

"Corrugated" paper includes a sheet of corrugating medium that is shaped into a continuous rolling wave, called flutes, glued to at least one flat sheet, but usually glued between two flat sheets, called liner boards.

"Tensile strength" (adjective phrase) regarding paper or other sheet material is a measure of its resistance to breaking by elongation. As used herein, it is measured and expressed as the force per unit width of the sheet specimen (dry, in machine direction of manufacture, if applicable), which commonly is measured for a strip of the sheet material having a width of about 1 inch (25 mm). As used herein, tensile strength is measured according to the standards set by TAPPI (Technical Association of the Pulp and Paper Industry), Method T-494.

"Internal tearing resistance" (adjective phrase) is a measure of the force perpendicular to the plane of the paper necessary to tear a single sheet through a specified distance after the tear has already been started. As used herein, internal tearing resistance is measured according to the standards set by TAPPI (Technical Association of the Pulp and Paper Industry), Method T-414 (Elmendorf-type of method).

"Bursting strength" (adjective phrase) regarding paper or other sheet material is a measure of its resistance to rupturing, defined as the hydrostatic pressure needed to burst a sheet sample when it is applied uniformly across its side. More particularly, bursting strength is measured utilizing a rubber diaphragm that is expanded hydraulically against the sample sheet. A bursting test is also known as a Mullen test or pop test. A minimum bursting strength is required for cartons used for shipping, but the measure has less application to printing papers. This is determined more by the nature of its fiber than its thickness. For a paper, high bursting strength is achieved by forming the paper with a tight weave of long fibers so that they are both vertical and horizontal within the paper. As used herein, bursting strength of a paper material is measured according to the standards set by TAPPI (Technical Association of the Pulp and Paper Industry), Method T-403.

Folding resistance (adjective phrase) regarding a paper or other sheet material is a measure of the ability of a paper to maintain its strength after repeated folding. There are at least two test apparatuses and methods used for evaluating this property, one using the Schopper tester, another using the MIT tester. The essential differences between these methods arise from the design and function of the test apparatus. In both methods, the test specimen is held under tension and subjected to repeated folding; the number of folds necessary to cause failure is taken as a measure of folding endurance. The Schopper instrument operates at a rate of 120 double folds per minute. A reciprocating motion folds the specimen by looping it snugly around a small cylindrical surface. During the reciprocating motion, the tension applied to the 15-mm-wide test specimen fluctuates between approximately 800 g to 1 kg (7.8 to 9.8 N) in normal operation. The MIT apparatus applies a double fold of 270° (±135°) at a rate of 175 double folds per minute by means of an oscillating jaw-like clamp. The MIT allows a wider range of paper thicknesses to be used, and the calibration and adjustment of the MIT instrument is less demanding than that of the Schopper. Test results obtained with these methods are not inter-convertible. D. F. Caulfield and D. E. Gunderson, Paper Testing and Strength Characteristics, 1988, TAPPI proceedings of the 1988 paper preservation symposium, 1988 Oct. 19-21, Washington D.C., TAPPI Press, pp. 31-40. As used herein, folding endurance of a paper material is measured according to the standards set by TAPPI (Technical Association of the Pulp and Paper Industry), Method T-423 (Schopper-type test method).

Adhesive, Adhere and Adherence Strength

"Adhesive" (noun) means a substance or material that unites, bonds, or holds surfaces together. Examples of adhesives include glue, pressure-sensitive adhesive, adhesive temporarily covered with a removable, protective strip, double-sided tape, water-resistant adhesive.

"Adhere" (verb) means to stick or hold together and resist separation.

"Adhesive strength" (adjective phrase) means the force required to break an adhesive bond. There are many test methods used to determine the strength of an adhesive including peel, shear, cleavage, and tension tests. Peel tests are common for tapes, labels, coatings, and other bonded materials. There are three main types of peel tests including 90-degree peel test, 180-degree peel test, and a T-Peel test. The 90-degree and 180-degree tests are commonly used where a flexible material with an adhesive or other bonding method is adhered to a more rigid substrate. The 90-degree peel test is used over the 180-degree peel test if the flexible substrate cannot be bent cleanly back to 180 degrees. The T-peel test requires that both of the bonded substrates be very flexible.

Indicia (E.g., for Advertising)

"Indicia" (noun) means distinctive marks.

"Advertisement" (noun) or "advertising" (noun) means a public promotion of some product or service.

"Advertising" (verb) means to make publicity for or to try to sell a product or service.

Functions

"Permanent" (adjective) means continuing or enduring without marked change in status or condition or place, especially within a relevant time, such as for the intended use of an article.

"Temporary" (adjective) means not permanent.

"Adjacent" (adjective) means nearest in space or position or means immediately adjoining without intervening space.

"Wrap" (verb) means to wrap or coil around something else.

"Friction" (noun) means the resistance encountered when one body is moved in contact with another.

"Slip" (verb) means to move smoothly and easily.

"Fold" (verb) means to bend or lay so that one part covers the other.

"Crease" (noun) means an angular shape made by folding.

"Bulge" (or protrude, pop out, bulge out, bug out, come out, bulge outward) (verb) refers to a way to change shape, change form, deform.

"Disposable" (adjective) regarding an article means disposable in a municipal landfill according to current disposability standards.

"Ignitable" (adjective) means possible to ignite the material to then continue burning in air at standard temperature and pressure.

"Flushable" in plumbing (adjective phrase) means able to flow freely (in typical US toilet plumbing), without clogging the plumbing.

Biodegradable

Biodegradable means the process by which complex molecules are broken down by micro-organisms to produce simpler compounds. Biodegradation can be either aerobic (with oxygen) or anaerobic (without oxygen). The potential for biodegradation is commonly measured on fluids or their components to ensure that they do not persist in the environment. A variety of standard tests can be used to assess biodegradation.

As used herein, a substance is considered "biodegradable" if the substance passes a ready biodegradability test or an inherent biodegradability test. It is preferred that a substance is first tested for ready biodegradability, and only if the substance does not pass at least one of the ready biodegradability tests then the substance is tested for inherent biodegradability.

In accordance with Organisation for Economic Co-operation and Development ("OECD") guidelines, the following six tests permit the screening of substances for ready biodegradability. As used herein, a substance showing more than 60% biodegradability in 28 days according to any one of the six ready biodegradability tests is considered a pass level for classifying it as "readily biodegradable," and it may be assumed that the substance will undergo rapid and ultimate degradation in the environment. The six ready biodegradability tests are (1) 301A: DOC Die-Away; (2) 301B: CO2 Evolution (Modified Sturm Test); (3) 301C: MITI (I) (Ministry of International Trade and Industry, Japan); (4) 301D: Closed Bottle; (5) 301E: Modified OECD Screening; and (6) 301F: Manometric Respirometry.

In accordance with OECD guidelines, the following three tests permit the testing of chemicals for inherent biodegradability. As used herein, a substance with a biodegradation or biodegradation rate of >20% is regarded as "inherently primary biodegradable." A substance with a biodegradation or biodegradation rate of >70% is regarded as "inherently ultimate biodegradable." As used herein, a substance passes the inherent biodegradability test if the substance is regarded either as inherently primary biodegradable or inherently ultimate biodegradable when tested according to any one of three inherent biodegradability tests. The three tests are: (1) 302A: 1981 Modified SCAS Test; (2) 302B: 1992 Zahn-Wellens Test; and (3) 302C: 1981 Modified MITI Test. Inherent biodegradability refers to tests that allow prolonged exposure of the test compound to microorganisms, a more favorable test compound to biomass ratio, and chemical or other conditions that favor biodegradation.

Embodiments of Article for Use as a Sleeve or Coaster for a Beverage Container

In general, the disclosure provides an article that can be formed into a sleeve or a coaster for a beverage container. A beverage container has a generally cylindrical body. The article includes: (a) a first sheet, wherein the first sheet has an outer surface and an inner surface, wherein the first sheet is at least sufficiently flexible to be longitudinally wrapped around the generally cylindrical body of the beverage container to position an inner surface of an end portion of the first sheet adjacent an outer surface of a tab portion of the first sheet to form an overlapping area between the end portion and the tab portion; (b) a first adhesive on a first portion of an inner surface of the first sheet, wherein the first portion is at least partially within the overlapping area; and (c) a second adhesive on a second portion of the inner surface of the first sheet, wherein the second portion is at least partially outside the overlapping area, and wherein the first adhesive and the second adhesive can be the same or different.

First Sheet—Overall Dimensions and General Shape (Re a Beverage Container)

In various embodiments, the first sheet has an overall length that is at least about equal to an overall circumference of the generally cylindrical body of the beverage container.

In various embodiments, the first sheet has an overall length that is less than 1.5 times an overall circumference of the generally cylindrical body of the beverage container.

In various embodiments, the first sheet has an overall width that is at most about equal to a height of the generally cylindrical body of the beverage container.

In various embodiments, a major portion of the first sheet is at least sufficient to cover at least about 50% of a surface area of the generally cylindrical body of the beverage container. In various embodiments, the major portion of the first sheet is at least sufficient to cover at least about 70% of a surface area of the generally cylindrical body of the beverage container.

In various embodiments, the first sheet is generally rectangular.

In various embodiments, dimensions of the first sheet are selected or optimized for use with the beverage container having the generally cylindrical body of a particular overall height and a particular overall circumference.

First Sheet—Shape of Tab Portion

In various embodiments, the tab portion of the first sheet has the general shape of a rectangular tab. In various embodiments, the tab portion of the first sheet has a height that is less than a height of the end portion of the first sheet. In various embodiments, the tab portion of the first sheet has a smaller area than the area of the end portion of the first sheet.

First Sheet—Physical Properties

In various embodiments, the first sheet is structural.

In various embodiments, the first sheet is longitudinally flexible. In various embodiments, the first sheet is flexible in any orientation.

In various embodiments, the first sheet is non-corrugated.

In various embodiments, the first sheet can have more than one ply.

In various embodiments, the first sheet has a weight of at least about 50 g/m$^2$ using TAPPI Method T-410. In various embodiments, the first sheet has a weight of in the range of about 50-500 g/m$^2$ using TAPPI Method T-410. In various embodiments, the first sheet has a weight of in the range of about 50-250 g/m$^2$ using TAPPI Method T-410.

In various embodiments, the first sheet has a thickness of less than about 0.050 inch (about 1.3 mm), and more preferably less than about 0.020 inch (0.5 mm), and most preferably less than about 0.010 inch (0.25 mm) using TAPPI Method T-411. In various embodiments, the first sheet has a thickness in the range of about 0.002-0.050 inch (about 0.05 mm to 1.3 mm) using TAPPI Method T-411.

In various embodiments, the first sheet has a tensile strength of at least about 10 lb/in (1.1 N/m) using TAPPI Method T-494. In various embodiments, the first sheet has a tensile strength of at least about 30 lb/in (3.4 N/m) using TAPPI Method T-494.

In various embodiments, the first sheet has internal tearing resistance of at least about 500 mN using TAPPI Method T-414. In various embodiments, the first sheet has internal tearing resistance of at least about 1,000 mN using TAPPI Method T-414.

In various embodiments, the first sheet has bursting strength of at least about 10 pounds per square inch (psi) using TAPPI Method T-403. In various embodiments, the first sheet has bursting strength of at least about 30 pounds per square inch (psi) using TAPPI Method T-403.

In various embodiments, the first sheet has a folding resistance of at least 100 double folds in the weakest direction at 1 kg load using TAPPI Method T-511. In various embodiments, the first sheet has a folding resistance of at least 1,000 double folds in the weakest direction at 1 kg load using TAPPI Method T-511.

First Sheet—Printable on Outer Surface

In various embodiments, the first sheet has an outer surface that is printable. In various embodiments, the article additionally comprises: indicia printed on at least a portion of the outer surface of the first sheet.

First Sheet—Printable on Inner Surface

In various embodiments, the first sheet has an inner surface that is printable. In various embodiments, the article additionally comprises: indicia printed on at least a portion of the outer surface of the first sheet.

First Sheet—Straight Edges

In various embodiments, the first sheet has longitudinal edges that are straight edges. In various embodiments, some or all of the edges of the first sheet are straight.

In various embodiments, the first sheet can have longitudinal edges that are deckled. In various embodiments, some or all of the edges of the first sheet are deckled.

First Sheet—Materials

In various embodiments, the first sheet comprises paper. In various embodiments, the paper is a coated paper.

In various embodiments, the first sheet comprises a plastic material. In various embodiments, the first sheet consists essentially of a plastic material. In various embodiments, the plastic material is selected from the group consisting of: various polymeric materials such as acrylic, polystyrene, polycarbonate, polyester, and polyvinyl (sometimes referred to simply as "vinyl").

In various embodiments, the plastic material does not comprise a closed-cell foamed plastic material. In various embodiments, the plastic material does not comprise an open-cell foamed plastic material.

In various embodiments, the first sheet comprises an exotic material, such as a self-illuminating material, a light-reflective material, or a temperature-responsive material, whereby a portion of the sheet material or indicia thereon can be displayed in the darkness, or reflect light, or change in response to a specific temperature or a change in temperature.

First Sheet—Adhesives

In various embodiments, each of the first adhesive and the second adhesive is a temporary adhesive. In various embodiments, the temporary adhesive is a pressure-sensitive adhesive.

In various embodiments, one or both of the first and second adhesives are temporarily covered with a protective film. The protective film can be, for example, a sheet material of plastic. For example, in various embodiments, the protective film can have a weight of at about 10 g/m$^2$ to about 50 g/m$^2$. A release material can be located between the protective film and the adhesive to ease the removal of the protective film from the adhesive.

First Sheet—As Sleeve

In various embodiments, the first sheet can be curled with the first adhesive attaching the end portion and tab portion of the first sheet to form a sleeve that can be used on the beverage container. In various embodiments, the second adhesive on the second portion of the inner surface of the first sheet can adhere the second portion of the inner surface of the sleeve onto the generally cylindrical body of the beverage container without allowing the beverage container to slip through the sleeve when the beverage container is lifted from a supporting surface. In various embodiments, any condensation on the beverage container can wet an inner surface of the sleeve, causing the inner surface to have higher affinity for or friction with the surface of the beverage container, thereby not allowing the beverage container to slip through the sleeve when the beverage container is lifted from a supporting surface. The second adhesive can act as a safety feature against the beverage container slipping through the sleeve if there is no condensation on the beverage container or if the condensation dries and an inner surface of the sleeve is no longer damp or wet, such that the beverage container might otherwise slip through and out the bottom of the sleeve if lifted from a supporting surface.

First Sheet—As Sleeve Flattened to Coaster

In various embodiments, the sleeve can be flattened forming two folds in the first sheet material into a folded and flattened condition as a coaster that can be used under the beverage container. In various embodiments, the second adhesive on the second portion of the inner surface of the first sheet can be used to adhere to an opposite portion of the inner surface of the first sheet to help prevent the flattened article from bulging or popping open from the folded and flattened condition as a coaster.

First Sheet—Folded in Half as Coaster

In various embodiments, the first sheet can be folded about in half forming one fold in the first sheet material with the inner surfaces of the first and tab portions of the first sheet adjacent to each other into a folded and flattened condition as a coaster that can be used under the beverage container. In various embodiments, the second adhesive on the second portion of the inner surface of the first sheet can be used to adhere to an opposite portion of the inner surface of the first sheet to help prevent the flattened article from bulging or popping open from the folded and flattened condition as a coaster.

First Sheet—Non Absorbent or Comprises Absorbent Material

In various embodiments, the first sheet is non-absorbent.

In various embodiments, the first sheet comprises an absorbent material.

In various embodiments, the first sheet is absorbent from at least an inner surface when wrapped around the generally cylindrical body of the beverage container.

In various embodiments, the first sheet has a water absorbency of at least 0.1 ml in a maximum of 90 seconds. In various embodiments, the first sheet has water absorbency of at least 0.1 ml in a maximum of 60 seconds.

First Sheet—Non-Insulating or Comprises Insulating Material

In various embodiments, the first sheet is non-insulating.

In various embodiments, the first sheet is or comprises an insulating material, whereby when the article is formed as a sleeve for a beverage container, the first sheet can insulate a person's bare hand from the cold or very cold serving temperature of the beverage container.

Second Sheet—Comprising Absorbent Material

In various embodiments, the article additionally comprises: a second sheet, wherein the second sheet is at least sufficiently flexible to be wrapped around the generally cylindrical body of the beverage container, and wherein the second sheet is affixed adjacent the inner surface of the first sheet.

In various embodiments, the first sheet is longitudinally flexible. In various embodiments, the first sheet is flexible in any orientation.

In various embodiments, the second sheet is affixed to the inner surface of the first sheet with a third adhesive, and wherein any of the first adhesive, the second adhesive, and the third adhesive can be the same or different.

In various embodiments, the third adhesive is a permanent adhesive.

In various embodiments, the second sheet is absorbent from at least an inner surface when wrapped around the generally cylindrical body of the beverage container.

In various embodiments, the second sheet is non-corrugated.

In various embodiments, the second sheet can have more than one ply.

Second Sheet—Dimensions and Location

In various embodiments, the area of the second sheet does not extend beyond the area of the first sheet. In various embodiments, the area of the second sheet is smaller than the area of the first sheet. In various embodiments, all of the area of the second sheet covers at least about 50% of the sheet area of the first sheet.

In various embodiments, the area of the second sheet does not overlap the first adhesive on the first portion, the second adhesive on the second portion, or the overlapping area.

Second Sheet—Physical Properties

In various embodiments, the second sheet has a water absorbency of at least about 0.1 ml in a maximum of 90 seconds. In various embodiments, the second sheet has water absorbency of at least about 0.1 ml in a maximum of 30 seconds.

In various embodiments, the second sheet is non-structural.

In various embodiments, the second sheet is non-corrugated.

In various embodiments, the second sheet has a weight of at least about 20 g/m$^2$ using TAPPI Method T-410. In various embodiments, the second sheet has a weight of in the range of about 20-500 g/m$^2$ using TAPPI Method T-410. In various embodiments, the second sheet has a weight of in the range of about 50-300 g/m$^2$.

In various embodiments, wherein the second sheet has a thickness less than 0.050 inch (about 1.3 mm), and more preferably less than about 0.020 inch (0.5 mm) using TAPPI Method T-411. In various embodiments, the second sheet has a thickness in the range of about 0.002-0.050 inch (about 0.05 mm to 1.3 mm) using TAPPI Method T-411.

Second Sheet—Materials

In various embodiments, the second sheet is of a material selected from the group materials used for paper napkins, paper towels, and blotting paper (also known as bibulous paper).

Second Sheet—Printable on Inner Surface

In various embodiments, the second sheet has an inner surface that is printable.

In various embodiments, the article additionally comprising: indicia printed on at least a portion of an inner surface of the second sheet.

Second Sheet—Without Interfering with First and Second Adhesives

In various embodiments, when the first sheet is wrapped around the beverage container such that the end portion and tab portion are overlapping to each other, the end portion and tab portion of the first sheet can overlap without interference from the second sheet. For example, in various embodiments, the second sheet does not interfere with the location and purposes of the first and second adhesives.

Article Disposability

In various embodiments, wherein the article is disposable in a landfill.

In various embodiments, the article is not flushable.

In various embodiments, the first sheet is ignitable.

In various embodiments, the article is biodegradable.

Embodiments of Article in Combination with a Beverage Container

In various embodiments, an article according to the disclosure is in combination with the beverage container.

In various embodiments, the article is wrapped as a sleeve for the beverage container.

In various embodiments, the article is flattened as a coaster for the beverage container.

In various embodiments, the beverage container is a bottle having a US standard size for the cylindrical body portion.

In various embodiments, the beverage container is a can having a US standard size for the cylindrical body portion.

Embodiments of Article in Combination with a Dispenser

In various embodiments, an article according to the disclosure is in combination with a dispenser.

In various embodiments, the article is one of a plurality of such articles in the dispenser.

In various embodiments, the article is disposed in the dispenser in a flat condition without being curled or folded.

In various embodiments, the dispenser is in the general form of a tray.

In various embodiments, the article and dispenser additionally in combination with the beverage container.

Embodiments of Article in Combination with a Beverage Container and Dispenser

In various embodiments, an article according to the disclosure in combination with a dispenser and the beverage container.

Embodiments of Methods of Using Article

In various embodiments, methods of using the article according to various embodiments of the disclosure are provided, the methods comprising steps of: (a) wrapping the article around the generally cylindrical body of the beverage container to position an inner surface of an end portion adjacent an outer surface of a tab portion to form the overlapping area between the end portion and the tab portion; (b) using the first adhesive to adhere the end portion and the tab portion of the overlapping area.

In various embodiments, the methods include a serving temperature for a hot or cold beverage in the beverage container. In various embodiments, the methods include wherein the beverage is at a serving temperature in the range of about 0-4° C. (about 32-39° F.).

In various embodiments, methods of using the article according to various embodiments of the disclosure are provided, the methods comprising steps of: (a) curving the article into a cylindrical shape to position an inner surface of an end portion adjacent an outer surface of a tab portion to form the overlapping area between the end portion and the tab portion; (b) using the first adhesive to adhere the end portion and tab portion of the overlapping area. In various embodiments, the methods additionally comprise a step of: flattening the article in the form of a sleeve by forming two fold lines in the first sheet material and thereby forming the article into a folded and flattened condition as a coaster that can be used under the beverage container. In various embodiments, the methods additionally comprise a step of: positioning the coaster under the beverage container.

In various embodiments, methods of using the article according to various embodiments of the disclosure are provided, the methods comprising steps of: folding the first sheet about in half forming one fold in the first sheet material with the inner surfaces of the end portion and the tab portion of the first sheet adjacent to each other into a folded and flattened condition as a coaster that can be used under the beverage container. In various embodiments, the methods additionally comprise a step of: positioning the coaster under the beverage container. In various embodiments, the methods additionally comprise a step of: using the second adhesive on the second portion of the inner surface of the first sheet to adhere to an opposite portion of the inner surface of the first sheet to help prevent the flattened article from bulging or popping open from the folded and flattened condition as a coaster.

Examples of Embodiments

To facilitate a better understanding of the present disclosure, the following specific embodiments and examples are provided. In no way should these necessarily limit or define the entire scope of the disclosure.

Table 1 includes descriptive names and references regarding the specific embodiments illustrated in one or more of the Figures of the drawing. It should be understood, however, the structures and methods of these examples and Figures are merely illustrative, and that other structures or variations are contemplated within the scope of this disclosure.

TABLE 1

Figure 2:
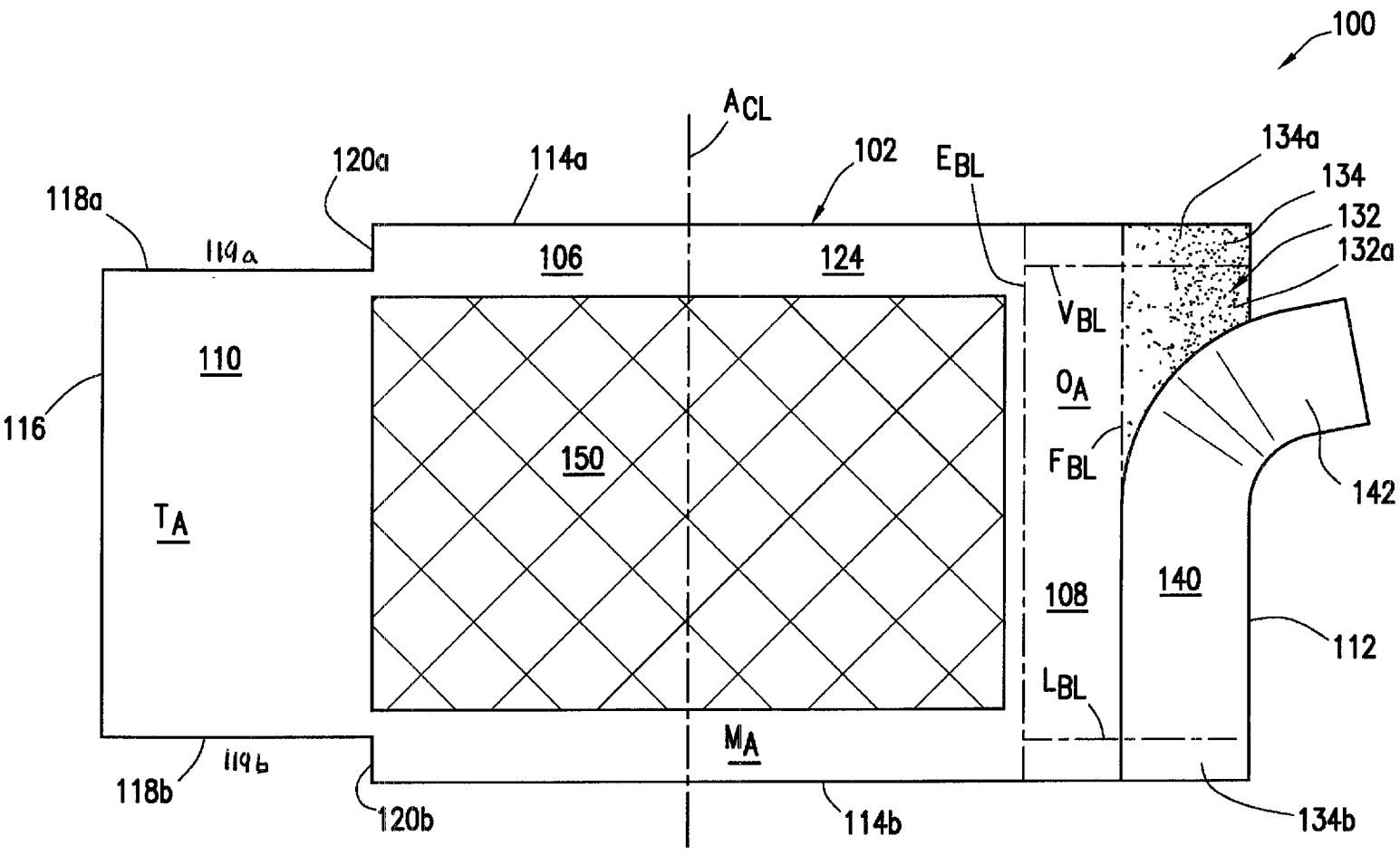
FIG. 2 is a view of the article FIG. 1, except that the article is rotated 180 degrees about the article centerline $A_{CL}$, such that an inner surface of the first sheet is shown facing upward. Adhesive, such as a pressure-sensitive adhesive, is shown on the end of the first sheet (right side as shown in this FIG. 2). In various embodiments, the adhesive material can be covered with a temporary, protective film. In addition, a second sheet of absorbent material is positioned on the inner surface of the first sheet.
Figure 4:
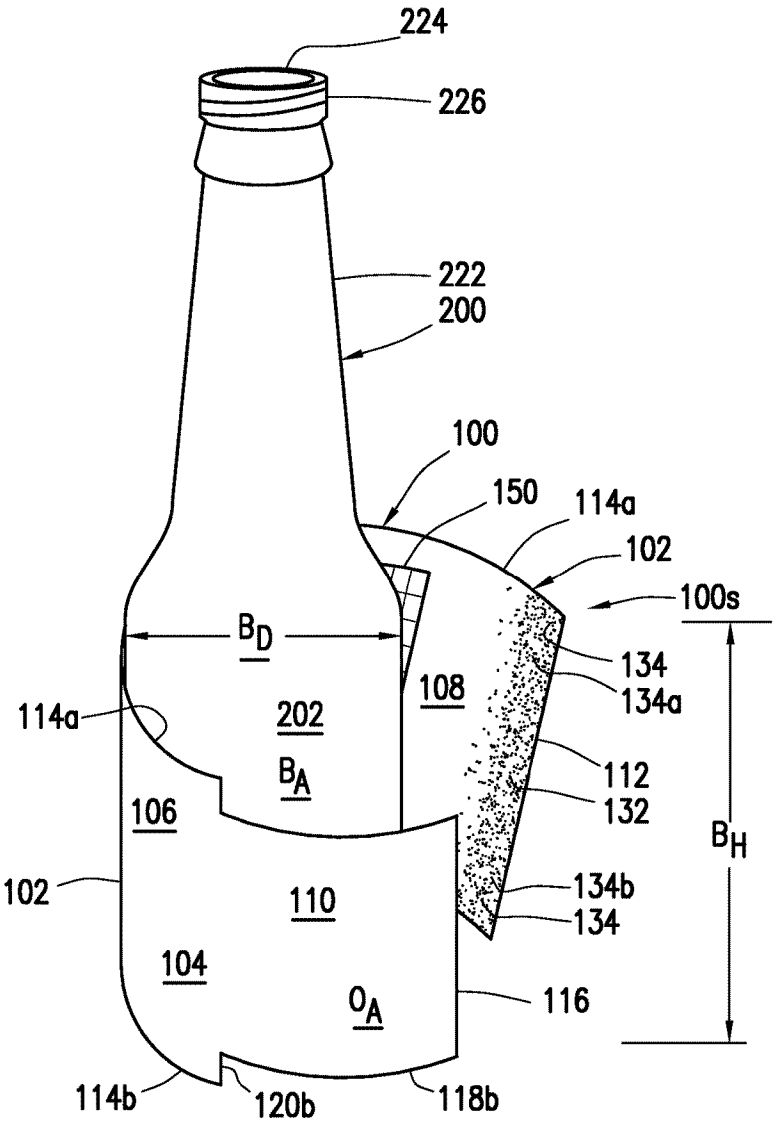
FIG. 4 is a view showing the article of FIGS. 1-2, except wherein the article is shown in the process of being positioned and wrapped around a beverage container, such as a beverage bottle (hands not shown). When the first sheet is fully wrapped around a beverage container such as the bottle, there is still an exposed portion of adhesive for adhering the article to the surface of bottle. Note optional inner sheet of absorbent material. The advertising indicia of the article as shown in FIG. 1 is not shown in FIG. 4.
Figure 3:
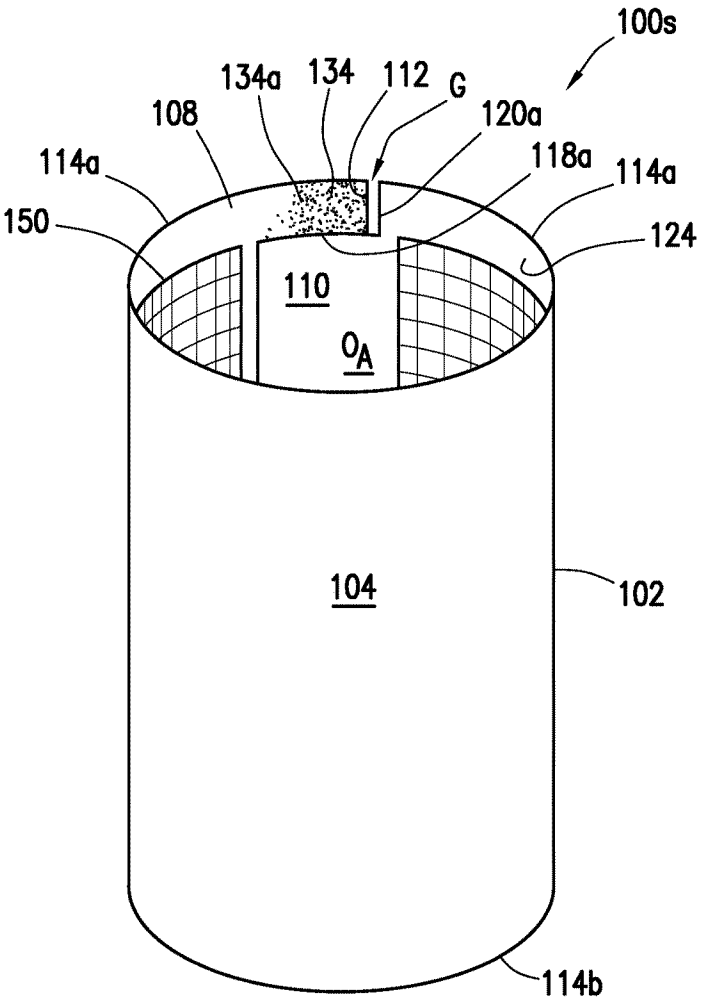
FIG. 3 is a view of the article of FIGS. 1-2, except wherein the article is positioned into the form of a stand-alone sleeve. A first adhesive (not visible in the view of FIG. 3) is used to join an overlapping area (not visible in FIG. 3) of the end portion and the tab portion of the article. A second adhesive on a second portion of the inner surface of the first sheet is exposed outside of the area of the tab portion, which can adhere the article to a beverage container (not shown in FIG. 3). The advertising indicia of the article 100 as shown in FIG. 1 is not shown in FIG. 3.
Figure 5:
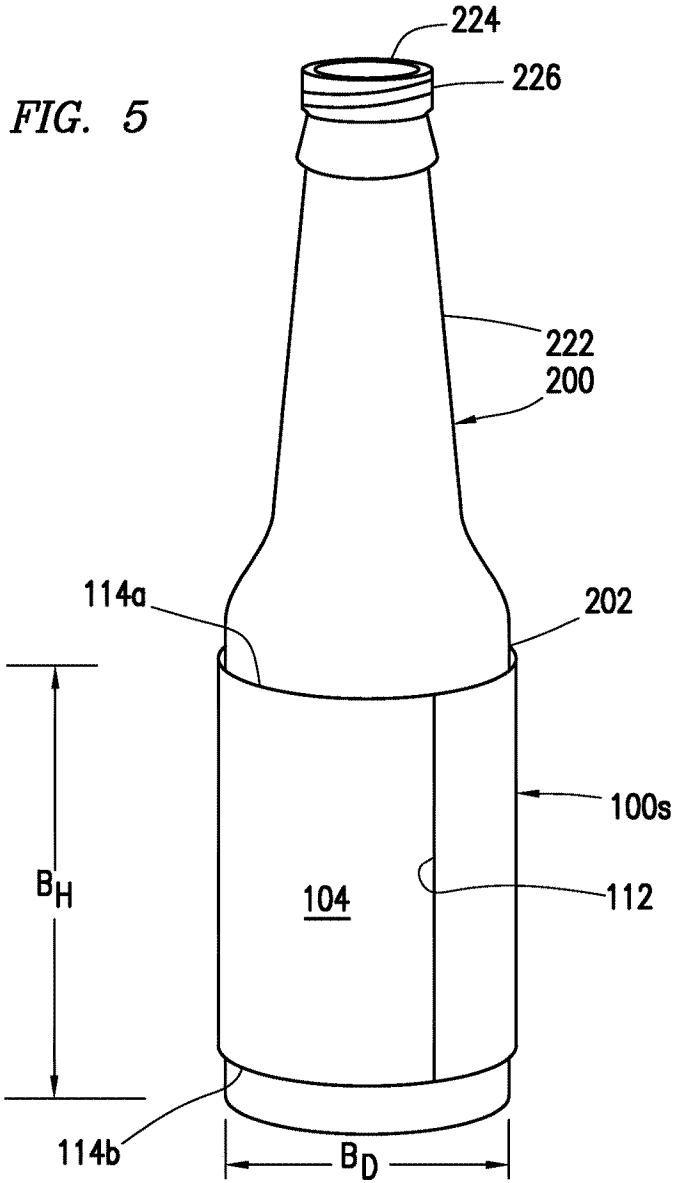
FIG. 5 is a view showing the article of FIGS. 1-2 fully positioned around the cylindrical body of the beverage bottle as a sleeve. The advertising indicia of the article as shown in FIG. 1 is not shown in FIG. 5.

| Example of Element or Feature | Reference |
|---|---|
| References for FIG. 1 | |
| Article | 100 |
| Length (of article) | $A_L$ |
| Height (of article) | $A_H$ |
| Center line (of article) | $A_{CL}$ |
| First sheet (of article) | 102 |
| Outer surface (of first sheet) | 104 |
| Major portion (of first sheet) | 106 |
| End portion (of first sheet, included in the major portion) | 108 |
| Tab portion (outside of major portion) | 110 |
| (Major Portion Description) | |
| First end edge (of major portion of first sheet) | 112 |
| Longitudinal edges (of major portion of first sheet) | 114a, 114b |
| Length (of major portion) | $M_L$ |
| Height (of major portion) | $M_H$ |
| Area (of major portion) | $M_A$ |
| (End Portion Description) | |
| Boundary line (of end portion) | $E_{BL}$ |
| Length (of end portion) | $E_L$ |
| Height (of end portion) | $E_H$ |
| Area (of end portion) | $E_A$ |
| (Tab Portion Description) | |
| Tab end edge (of tab portion) | 116 |
| Boundary line (of tab portion) | $T_{BL}$ |
| Longitudinal edges (of tab portion of first sheet) | 118a, 118b |
| Vertical edges (of tab portion of first sheet) | 120a, 120b |
| Length (of tab portion) | $T_L$ |
| Height (of tab portion) | $T_H$ |
| Area (of tab portion) | $T_A$ |
| Indicia on outer surface of first sheet | "Advertising Indicia" |
| Additional References for FIG. 2 | |
| Inner surface (of first sheet) | 124 |
| Overlapping Area (of end & tab portions) | $O_A$ |
| Upper and Lower Boundary Lines (relines 118a and 118b) | $U_{BL}$ and $L_{BL}$ |
| First adhesive | 132 |
| Second adhesive | 134 |
| First portion (for first adhesive) | 132a |
| First portion boundary line | $F_{BL}$ |
| Second portions (for second adhesive) | 134a and 134b |
| Temporary film (covering the first or second adhesives) | 140 |
| End (of temporary film shown being lifted away from adhesives) | 142 |
| Second sheet (of absorbent material) | 150 |
| Third adhesive (between 1st sheet & 2nd sheet) | Not shown |
| Additional References for FIG. 3 | |
| Article in form of a sleeve | 100s |
| Gap | G |
| Additional References for FIGS. 4 and 5 | |
| Beverage bottle | 200 |
| Cylindrical body (of a beverage container) | 202 |
| Circumference (of cylindrical body) | $B_C$ (Not shown) |
| Diameter (of cylindrical body) | $B_D$ |
| Height (of cylindrical body) | $B_H$ |
| Area (of cylindrical body) | $B_A$ |
| Neck (of beverage bottle) | 222 |
| Opening (at top of neck on bottle for drinking) | 224 |
| Threaded (at top of neck for threaded cap) | 226 |
| Cap (not shown) | Not shown |

TABLE 1-continued

Figure 6:
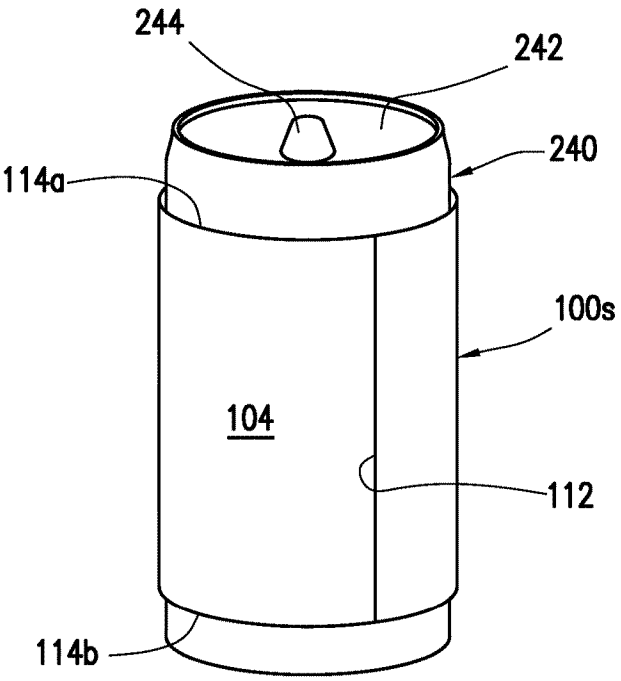
FIG. 6 is a view showing the article of FIGS. 1-2 positioned around the cylindrical body of a beverage can as a sleeve. The advertising indicia of the article as shown in FIG. 1 is not shown in FIG. 6.
Figure 7:
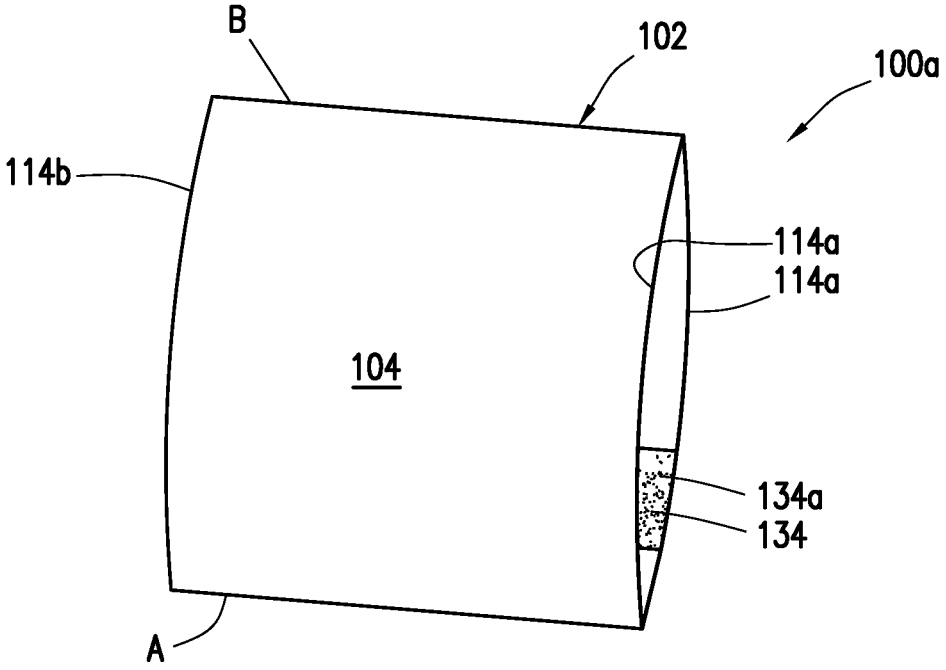
FIG. 7 is a view wherein the article 100 of FIGS. 1-2 had been first formed into a sleeve illustrated in FIG. 3 and then in the process of the sleeve form being flattened, the flattening bending the first sheet of the article forming two creases in the first sheet, whereby the article is in the process of being formed as a coaster for use with a beverage container. Note that the advertising indicia on the outer surface of the first sheet of the article as shown in FIG. 1 is not shown in FIG. 7.
Figure 8:
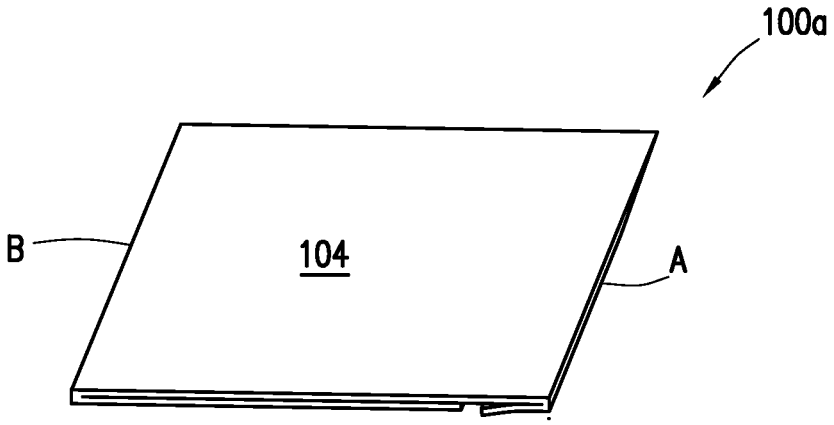
FIG. 8 is a view showing the article as in FIG. 7, but retained in a fully flattened position by the second adhesive affixing the second portions and to now oppositely position portions of the inner surface of the major area of the first sheet. Again, note that the advertising indicia on the outer surface of the first sheet of the article as shown in FIG. 1 is not shown in FIG. 8.
Figure 9:
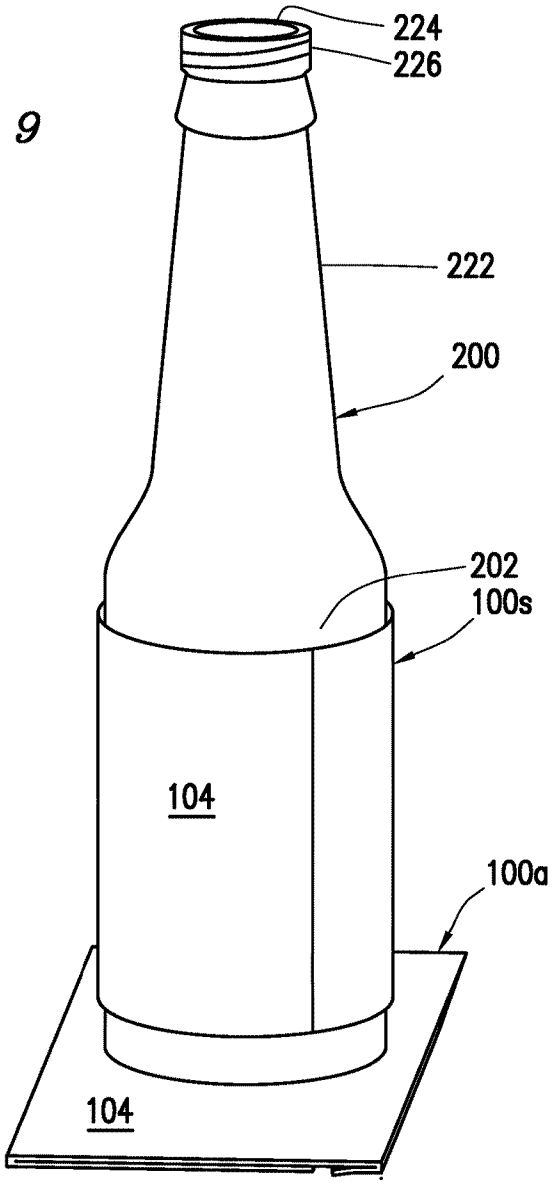
FIG. 9 is a view showing a beverage bottle positioned standing on the article of FIGS. 1-2 in the form of a coaster as in FIG. 8. Again note, that the advertising indicia on the outer surface of the first sheet of the article as shown in FIG. 1 is not shown in FIG. 9.
Figure 13A:
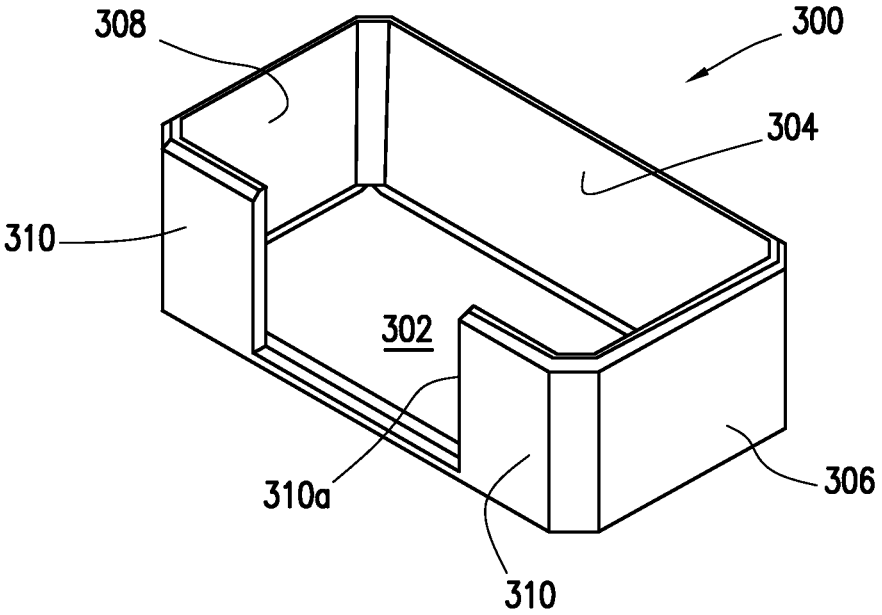
FIGS. 13A-B illustrate a "simple" dispenser in the general form of a tray adapted for stacking, storing, and conveniently dispensing a stacked plurality of the articles in the flat, unused position of FIGS. 1-2.
Figure 13B:
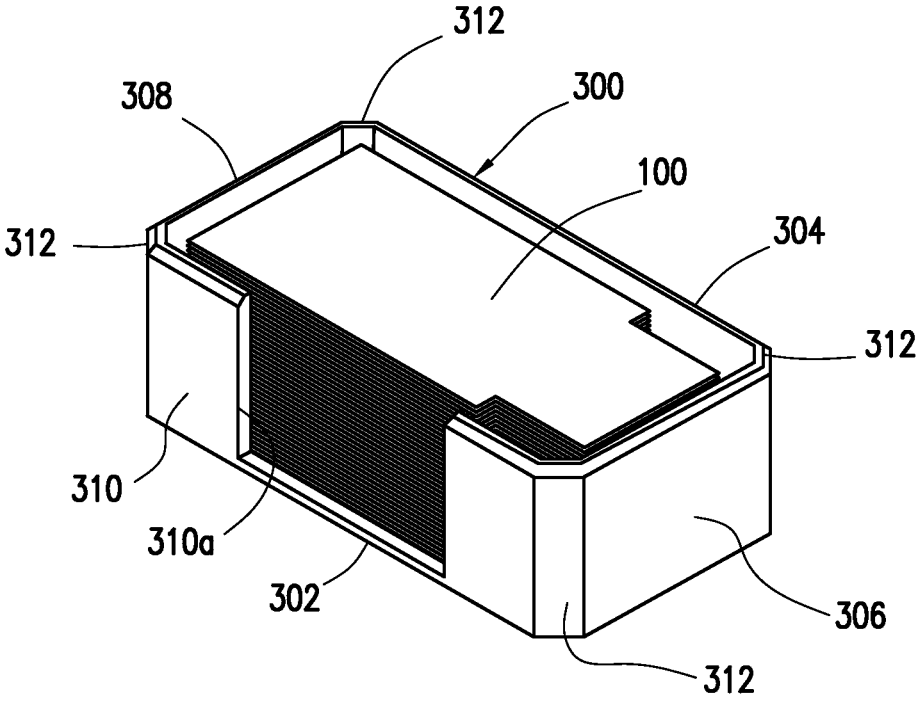
Figure 14A:
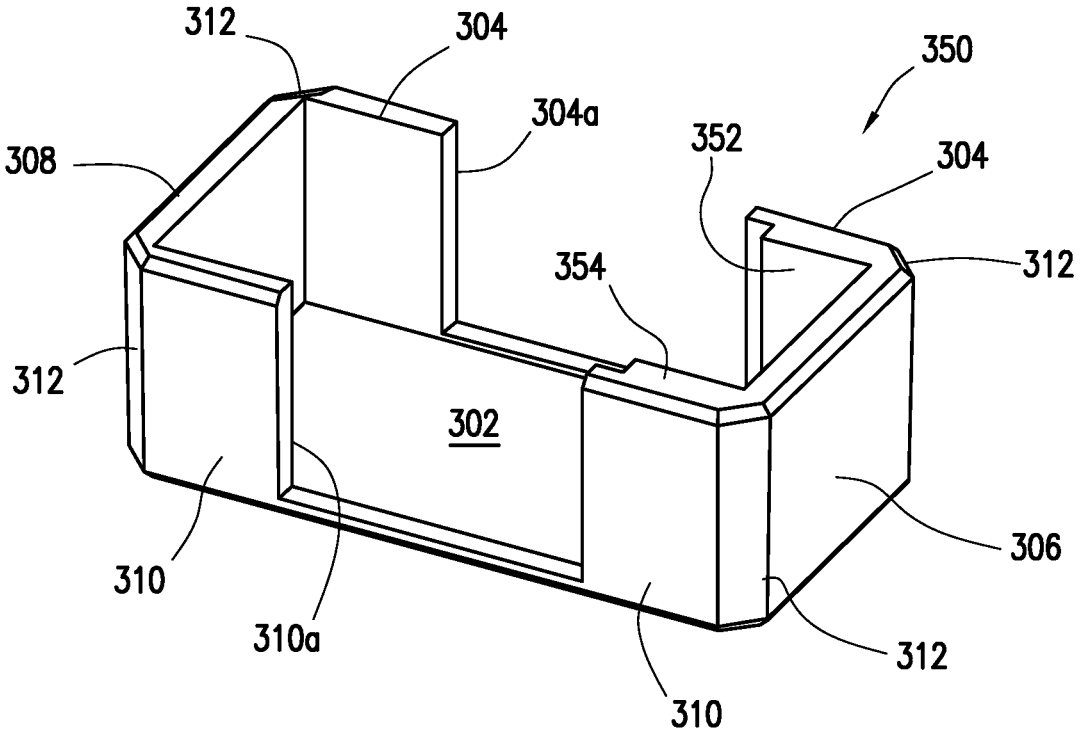
FIGS. 14A-B illustrate a "custom" dispenser adapted for stacking, storing, and conveniently dispensing the articles of FIGS. 1-3, similar to the "simple" dispenser of FIGS. 13A-B, except having blocking vertical wall portions specially shaped and located to conform with the tab portion of the articles when in a flat, unused position as in FIGS. 1-2, and, thereby, more neatly retaining a stacked plurality of the articles.
Figure 14B:
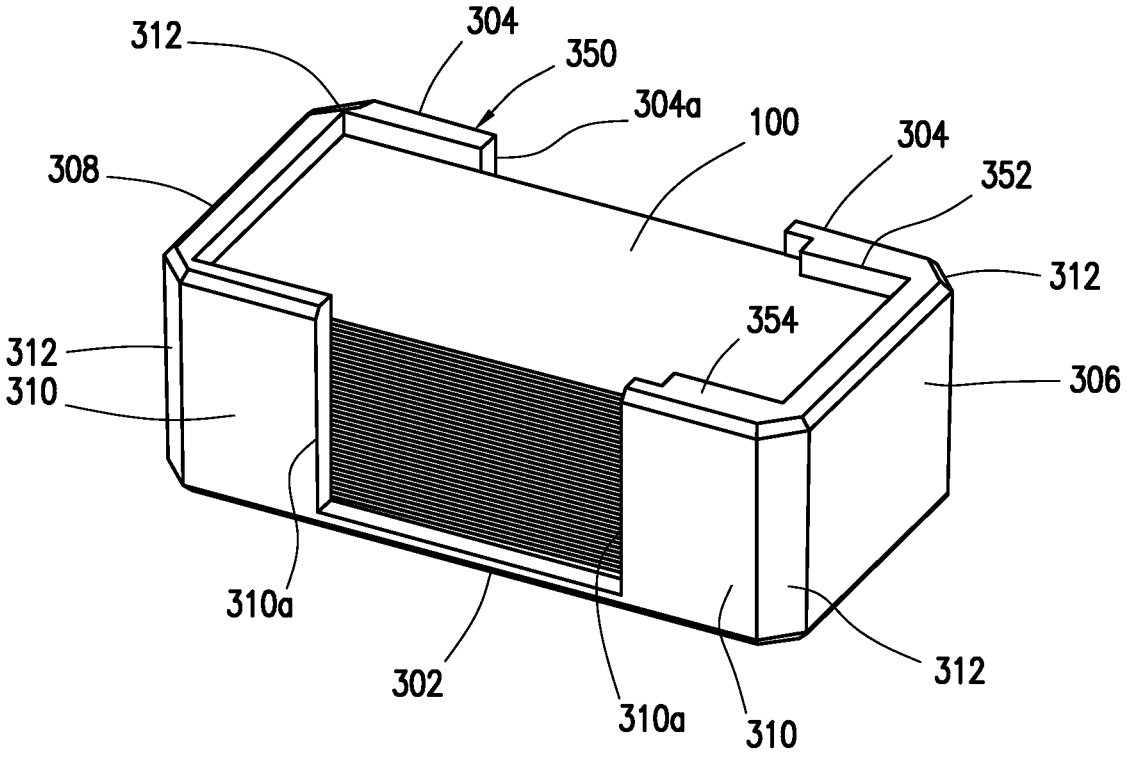

| Example of Element or Feature | Reference |
|---|---|
| Additional References for FIG. 6 | |
| Beverage can | 240 |
| Top (of can) | 242 |
| Tab (on top of can for opening and drinking) | 244 |
| Additional References for FIGS. 7 and 8 | |
| Article in form of a coaster with two creases | 100a |
| First crease | A |
| Second crease | B |
| Additional References for FIG. 9 | |
| Article in form of a coaster with single, center crease | 100b |
| Center crease | C |
| Additional References for FIGS. 13A and 13B | |
| "Simple Dispenser" | 300 |
| Bottom wall | 302 |
| Back vertical wall | 304 |
| First side vertical wall | 306 |
| Second side vertical wall | 308 |
| Front vertical wall | 310 |
| Opening (between front vertical wall portions) | 310a |
| Angular corners (optional, between all vertical walls) | 312 |
| Additional References for FIGS. 14A and 14B | |
| "Custom Dispenser" | 350 |
| Opening (between front vertical wall portions) | 304a |
| Back blocking vertical wall portion | 352 |
| Front blocking vertical wall portion | 354 |

FIG. 1 is a view of an embodiment of an article 100 according to the disclosure, showing the article 100 in a flat, unfolded position. The article 100 can be in such a condition before being manipulated and formed for use as a sleeve or coaster for a beverage container, as will be described in more detail. As shown in FIG. 1, the article 100 has an overall length $A_L$ and an overall height $A_H$. The article 100 is relatively thin, but the thickness of the article 100 is not shown the view of FIG. 1. In addition, a vertical centerline $A_{CL}$ for the article 100 is indicated as a reference line at about the middle of the overall length $A_L$ of the article. (It should be understood that the reference line $A_{CL}$ is an imaginary reference line, not necessarily visible or indicated on the article 100.)

The article 100 includes at least a first sheet 102. In FIG. 1, the first sheet 102 is illustrated with the outer surface 104 of the first sheet 102 facing upward. The first sheet 102 has the same overall shape of the article 100 as illustrated in FIG. 1, including the same overall length $A_L$ and the same overall height $A_H$ as the article 100. The first sheet 102 of the article 100 is of a relatively thin material, but the thickness of the first sheet 102 is not shown the view of FIG. 1. In the illustrated embodiment, the first sheet 102 is of a single, contiguous sheet material, such as of paper or a plastic material.

The first sheet 102 of the article 100 has a major portion 106, which includes an end portion 108 (as will be described in more detail) and the first sheet 102 also has a tab portion 110 (as will be described in more detail), which is outside of the major portion 106.

The major portion 106 has a first end edge 112 and longitudinal edges 114*a* and 114*b*. The longitudinal edges 114*a* and 114*b* of the major portion 106 have a longitudinal dimension $M_L$. The major portion 106 of the first sheet 102 has an overall height that is the same as the overall height $A_H$ of the article 100, which with particular reference to the major area 106 may sometimes be referred to as $M_H$. In addition, the major portion 106 has an area $M_A$.

The end portion 108 is a strip of the major portion 106 along the first end edge 112. The end portion 108 is bounded between the first end edge 112 and an end portion boundary line $E_{BL}$, as shown in FIG. 1. (It should be understood that the end portion boundary line $E_{BL}$ is an imaginary reference line, not necessarily physically visible or indicated on the article 100.) In the illustrated embodiment of the article 100, the end portion 108 has a longitudinal dimension $E_L$ between the first end edge 112 and the reference boundary line $E_{BL}$ that is about equal to the length of the tab portion 110 (as described in more detail below). The end portion 108 of the first sheet 102 has an overall height that is the same as the overall height $A_H$ of the article 100, which with particular reference to the end portion 108 may sometimes be referred to as end height $E_H$. In addition, the end portion 108 has an end portion area $E_A$.

In the embodiment of the article 100 shown in FIG. 1, the tab portion 110 of the first sheet 102 is outside but adjacent to and contiguous with the major portion 106. In the illustrated embodiment of the article 100, the tab portion 110 is smaller than the end portion 108, a tab portion need not necessarily be smaller than the end portion 108. The tab portion 110 of the article has a tab end edge 116. The tab portion 110 is bounded between the tab end edge 116 and a tab boundary line $T_{BL}$, as shown in FIG. 1. (It should be understood that the tab boundary line $T_{BL}$ is an imaginary reference line, not necessarily physically visible or indicated on the article 100.) In addition, the tab portion 110 has longitudinal edges 118*a* and 118*b* and tab vertical edges 120*a* and 120*b*. Indentions 119*a* and 119*b* are bounded by longitudinal edges 118*a* and 118*b* and tab vertical edges 120*a* and 120*b*. The tab portion 110 and the longitudinal edges 118*a* and 118*b* of the tab portion 110 have a longitudinal dimension $T_L$. The tab portion 110 and the tab end edge 116 have a height of $T_H$. In the illustrated embodiment of article 100, the tab portion 110 has an overall height that is less than the overall height $A_H$ of the article 100. In addition, the tab portion 110 has a tab area $T_A$.

In the illustrated embodiment of article 100 shown in FIG. 1, the sum of the major portion length $M_L$ and tab portion length $T_L$ equals the article length $A_L$. The tab portion height $T_H$ is less than the article height $A_H$, the difference being the sum of the two dimensions of tab vertical edges 120*a* and 120*b*. Accordingly, the sum of $T_H$ and the dimensions of vertical edges 120*a* and 120*b* is about equal to the article height $A_H$. The dimensions of vertical edges 120*a* and 120*b* can be equal to each other or different from each other, but in the illustrated embodiment of article 100, the dimensions of vertical edges 120*a* and 120*b* are about the same. In alternative embodiments, either or both of the tab edges 118*a* and 118*b* can be co-extensive with longitudinal edges 114*a* and 114*b*, respectively, wherein one or both of the tab vertical edges 120*a* and 120*b* may not be present. In such an embodiment, the tab height $T_H$ can be equal to the height $M_H$ of the major portion 106.

Indicia can be printed, embossed, or otherwise placed anywhere the outer surface 104 of the first sheet 102. For example, the indicia can be printed on the outer surface 104 of the major portion 106 of the first sheet 102. Indicia can also be printed on the outer surface 104 of the tab portion 110 of the first sheet 102, however, in some uses, that the outer surface 104 of the tab portion 110 may be covered up in overlapping relationship with the end portion 108, as is described in more detail below. The indicia can be, for example, one or more words, symbols, graphics, photographs, or any combination thereof as may be desired. In the article 100 illustrated in FIG. 1, any such indicia is represented by the words "ADVERTISING INDICIA".

FIG. 2 is a view of the Article 100 of FIG. 1, except that the article 100 is rotated 180 degrees about the reference of the article centerline $A_{CL}$, such that an inner surface 124 of the first sheet 102 is shown facing upward and the end portion 108 and tab portion 110 are in reversed positions relative to the article centerline $A_{CL}$.

As noted above, the first sheet 102 of the article 100 is of a relatively thin material, but the thickness of the first sheet 102 is not shown the view of FIG. 2. Again, in the illustrated embodiment, the first sheet 102 is of a single, contiguous sheet material, such as of paper or a plastic material.

As will be described in more detail with reference to other figures, the article 100 can be curved or folded such that the end portion area $E_A$ can be positioned overlapping the tab portion area $T_A$ to define or form an overlapping area $O_A$. Continuing to refer to FIG. 2, the overlapping area $O_A$ is illustrated on the first sheet 102 as being bounded by the vertical end boundary line $E_{BL}$ of the end portion 108 and upper and lower boundary lines $U_{BL}$ and $L_{BL}$ defined by the overlapping longitudinal edges 118*a* and 118*b*, respectively, of the tab portion 110. (It should be understood that the upper and lower boundary lines $U_{BL}$ and $L_{BL}$ are imaginary reference lines, not necessarily physically visible or indicated on the article 100.)

As will be described in more detail with reference to other figures, a first adhesive 132 can used to attach the end portion 108 to the tab portion 110. In addition, as will be described in more detail with reference to other figures, a second adhesive 134 can used to attach the article 100 to a beverage container or to keep the article 100 in a folded position. It should be understood that the first adhesive 132 and the second adhesive 134 can be the same or different and can be positioned adjacent to each other or at non-contiguous portions of the first sheet 102.

In the illustrated embodiment of the article 100 shown in FIG. 2, the first adhesive 132 is shown on the inner surface 124 of the first sheet 102 in a first portion 132*a* of the overlapping area $O_A$. The first portion 132*a* is bounded by first end edge 112, the upper and lower boundary lines $U_{BL}$ and $L_{BL}$, and a first boundary line $F_{BL}$ (It should be understood that the first boundary line $F_{BL}$ is an imaginary reference line, not necessarily physically visible or indicated on the article 100.) The first boundary line $F_{BL}$ can be anywhere between the first end edge 112 and the end portion boundary line $E_{BL}$, as may be appropriate or desired to provide sufficient area of the first portion 132*a* for the purpose and adhesive strength of the first adhesive 132.

In the illustrated embodiment of the article 100 shown in FIG. 2, the second adhesive 134 is shown on the inner surface 124 of the first sheet 102 in at least one, but preferably both of the second portions 134*a* and 134*b* of the overlapping area $O_A$. The second portion 134*a* is bounded by first end edge 112, the upper longitudinal edge 114*a*, the upper boundary line $U_{BL}$, and the first boundary line $F_{BL}$. The similar, second portion 134*b* is bounded by first end edge 112, the lower longitudinal edge 114*b*, the lower boundary line $L_{BL}$, and the first boundary line $F_{BL}$. Again, the first boundary line $F_{BL}$ can be anywhere between the first end edge 112 and the end portion boundary line $E_{BL}$, as may be appropriate or desired to provide sufficient areas for the second portions 134*a* and 134*b* for the purpose and adhesive strength of the second adhesive 134. It should be understood, however, that in various embodiments the second adhesive 134 can be positioned in any one or more portions on the inner surface 124 of the first sheet 102 outside of the overlapping area $O_A$ between the end portion 108 and the tab portion 110.

In the various embodiments, the first adhesive 132 and the second adhesive 134 are of the same material. It should be understood that many variations of the placement of the adhesives are possible that would still achieve the purposes as illustrated with the example of the embodiment of the article 100 as shown in FIG. 1 and FIG. 2.

In various embodiments, and in the embodiment of the article 100 illustrated in FIG. 2, the first and second adhesives 132 and 134, respectively, of portions 132*a*, 134*a*, and 134*b* can be covered with a temporary, protective film 140. As illustrated in FIG. 2, the film 140 is shown in the process of having an portion 142 being lifted and removed from covering the first adhesive 132 and second adhesive 134 of portions 132*a*, 134*a*, and 134*b*. Otherwise, it should be understood that before use, the film 140 would be flat and completely covering all the portions 132*a*, 134*a*, and 134*b*.

In the embodiment of the article 100 as illustrated in FIG. 2, the first sheet is not necessarily an absorbent material. In the embodiment of the article 100 as illustrated in FIG. 2, a second sheet 150 of an absorbent material is affixed to the inner surface 124 of the first sheet 102. The second sheet 150 can be, for example, an absorbent material such as of a paper towel. A third adhesive (not shown) between the second sheet 150 and the first sheet 102 can be used to hold the two sheets together. It should be understood that the adhesive is not necessarily required to cover the entire area of the second sheet 150. The third adhesive can be the same or different as either of the first and second adhesives. The second sheet 150 can cover any desired portion of the inner surface 124 of the first sheet 102, provided it does not interfere with the placement and functions of the first adhesive 132 and the second adhesive 134. In various embodiments, for example, the second sheet 150 can be completely co-extensive with the first sheet and the first adhesive 132 and second adhesive 134 can be positioned over the second sheet 150.

As will be shown in more detail with reference to later figures, the first sheet 102 is at least sufficiently flexible to be longitudinally (relative to the longest dimension of the first sheet 102) wrapped around the circumference of the generally cylindrical body of a beverage container. If there is a second sheet 150, it, too, should be at least similarly sufficiently flexible to be longitudinally wrapped around the circumference of the generally cylindrical body of a beverage container.

FIG. 3 is a view of the article 100 of FIGS. 1-2, except wherein the article is positioned into the form of a stand-alone sleeve. The first adhesive 132 (not visible in the view of FIG. 3) is used to join an overlapping area $O_A$ (not visible in FIG. 3) of the end portion 108 and the tab portion 110 of the article 100. A second adhesive 134 on a second portion 134*a* of the inner surface 124 of the first sheet 102 is exposed through indentions 119*a* and 119*b* outside of the area of the tab portion 110, which can adhere the article 100 to a beverage container (not shown in FIG. 3). The advertising indicia on the outer surface 104 of the article 100 as shown in FIG. 1 is not shown in FIG. 3.

In FIG. 3, a small gap G is illustrated between the first end edge 112 and the tab end edge 116. It should be understood that this gap G can be very small or non-existent. For example, the first end edge 112 can be overlapped with the tab edge 120*a*. This may be helpful depending on the exact dimensions of the article 100 relative to the particular dimensions of the cylindrical body of a beverage container (not shown in FIG. 3).

As best illustrated in FIG. 3, an advantage of the tab portion 110 being bounded by tab edge 118*a* that is not co-extensive with longitudinal edge 114*a* of the end portion 108 is that this feature avoids showing a double layer of the first sheet 102 at the longitudinal edge 114*a* of the end portion 108. In various embodiments, this can provide the appearance of a "seamless" overlap between the end portion 108 and the tab portion 110, which can be considered more aesthetically pleasing than if the tab edge 120*a* of tab portion 110 is overlapping with longitudinal edge 114*a* of the end portion 108. In the illustrated embodiment, the same is true regarding the lower longitudinal edge 114*b* and tab edge 118*b*, but tab edge 118*b* is not visible in FIG. 3.

Although not shown in the embodiment of FIG. 3, the second adhesive 134 can be located anywhere outside of the overlapping area $O_A$ that does not interfere with the location of any of second sheet 150, if a second sheet is present. For example, the second adhesive 134 can be located on the inner surface 124 of the first sheet 102 along one or both of longitudinal edges 114*a* and 114*b*, whereby when the article is in the form of a sleeve 100*s*, the second adhesive 134 can be exposed to contact the surface of a beverage container, as can be understood with viewing of the following FIGS. 4-6.

The advertising indicia on the outer surface 104 of the first sheet 102 of the article 100 as shown in FIG. 1 is not shown in FIG. 3.

FIG. 4 is a view showing the article 100 of FIGS. 1-2, except wherein the article 100 is shown in the process of being positioned and wrapped around a beverage container, such as a beverage bottle 200 (hands not shown).

As shown in FIG. 4, in general, a beverage container, such as beverage bottle 200, has a generally cylindrical body 202. The cylindrical body 202 of a beverage container has a circumference $B_C$ and a height $B_H$. The surface area $B_A$ of a cylindrical body is the circumference $B_C$ multiplied by the height $B_H$.

A beverage bottle 200 has a neck 222 and an opening 224 at the top of the neck 222 for drinking from the bottle 200. The top of the neck can have, for example, threads 226 adjacent to the opening 224 for attaching a removable cap (not shown).

The major portion 106 of the first sheet 102 can have dimensions that are selected or adapted for the particular beverage container such as the bottle 200 with which the article 100 is to be used. For example, the length $M_L$ of the major portion 106 of the first sheet 102 of the article 100 is can be selected or adapted to be about equal to the circumference $B_C$ of the beverage container, such as beverage bottle 200, for which the article 100 is intended or adapted to be used. The height $M_H$ of the major portion 106 of the first sheet 102 of the article 100 is preferably selected or adapted to be about equal to the height $B_H$ of the cylindrical body 202 of the beverage container, such as bottle 200, for which the article 100 is intended or adapted to be used. It should be understood, however, that the height $M_H$ of the major portion 106 of the first sheet 102 can be less than the height $B_H$ of the beverage container.

The tab portion 110 of the first sheet 102 can be of any convenient size and shape relative to the area of the first sheet 102 or the surface area $B_A$ of the cylindrical body 202 of the beverage container.

As illustrated in FIG. 4, the first adhesive 132 is positioned on the inner surface 124 of the end portion 108 of the first sheet 102 such that when the first sheet 102 is fully wrapped around the bottle 200, the first adhesive 132 is used to join an overlapping area $O_A$ between the end portion 108 and the tab portion 110 of the article 100, which overlapping area $O_A$ is indicated on the tab portion 110.

A second adhesive 134 on a second portion 134*a* of the inner surface 124 of the first sheet 102 is positioned to be exposed outside of the overlapping area $O_A$ with the tab portion 110 so that the second adhesive 134 can adhere the article 100 to the beverage bottle 200 after fully wrapping the article 100 around the beverage container.

The second sheet 150 of an absorbent material affixed to the inner surface 124 of the first sheet 102 is visible in FIG. 4.

The advertising indicia on the outer surface 104 of the first sheet 102 of the article 100 as shown in FIG. 1 is not shown in FIG. 4.

FIG. 5 is a view showing the article of FIGS. 1-2 fully positioned around the cylindrical body of the beverage bottle 200 as in the form of a sleeve 100*s*. The advertising indicia of the article 100 as shown in FIG. 1 is not shown in the article 100*s* in the form of a sleeve as illustrated in FIG. 5.

FIG. 6 is a view showing the article 100*s* of FIGS. 1-2 fully positioned around the body of the beverage can 240 as in the form of a sleeve.

As shown in FIG. 6, in general, a beverage container, such as beverage can 240, has a generally cylindrical body 202. The cylindrical body 202 of a beverage container has a circumference $B_C$ and a height $B_H$. The surface area $B_A$ of a cylindrical body 202 is the circumference $B_C$ multiplied by the height $B_H$.

A beverage can 240 has a top 242 and a tab 244 formed in the top 242 for opening and drinking from the can 240.

The major portion 106 of the first sheet 102 can have dimensions that are selected or adapted for the particular beverage container such as the can 240 with which the article in the form of a sleeve 100*s* is to be used. For example, the length $M_L$ of the major portion 106 of the first sheet 102 of the article 100 is can be selected or adapted to be about equal to the circumference $B_C$ of the beverage container, such as beverage bottle 200, for which the article 100 is intended or adapted to be used. The height $M_H$ of the major portion 106 of the first sheet 102 of the article 100 is preferably selected or adapted to be about equal to the height $B_H$ of the cylindrical body 202 of the beverage container, such as bottle 200, for which the article 100 is intended or adapted to be used. It should be understood, however, that the height $M_H$ of the major portion 106 of the first sheet 102 can be less than the height $B_H$ of the beverage container.

The tab portion 110 of the first sheet 102 can be of any convenient size and shape relative to the area of the first sheet 102 or the surface area $B_A$ of the cylindrical body 202 of the beverage container.

The process of placing the article 100 onto the beverage can 240 is similar to the process as illustrated in FIG. 3 of wrapping the article 100 onto the beverage bottle 200.

The advertising indicia on the outer surface 104 of the first sheet 102 of the article 100 as shown in FIG. 1 is not shown in FIG. 6.

FIG. 7 is a view wherein the article 100 of FIGS. 1-2 had been first formed into a sleeve 100*s* as illustrated in FIG. 3 and then in the process of the sleeve form 100*s* being flattened, the flattening bending the first sheet 102 of the article forming two creases in the first sheet 102, that is, a first crease A and a second crease B, whereby the article 100*s* is in the process of being formed as a coaster 100*a* for use with a beverage container such as a beverage bottle 200 or can 240 (neither of which are shown in FIG. 7). Optionally, creases A and B can be indicated by indicia (not shown), such as lines, on the outer surface 104 of the first sheet 102. Optionally, creases A and B can be pre-scored into first sheet 102 to help with folding the article 100 into the form of a coaster 100*a*.

FIG. 7 illustrates that in the absence of the second adhesive 134 on a second portion 134*a* (partially shown in FIG. 7), the first sheet 102 is likely to bulge or curve outward from the center, the top and bottom portions of the first sheet 102 of the article 100*a* not remaining fully flattened.

Note that the advertising indicia on the outer surface 104 of the first sheet 102 of the article 100 as shown in FIG. 1 is not shown in FIG. 7.

FIG. 8 is a view showing the article in coaster form 100*a* as in FIG. 7, but retained in a fully flattened position by the second adhesive 134 affixing the second portions 134*a* and 134*b* to now oppositely positioned portions of the inner surface 104 of the major area 106 of the first sheet 102 through indentions 119*a* and 119*b*. For use of the article 100*a* in this manner and coaster form, the second adhesive 134 is preferably a slightly tacky, pressure-sensitive adhesive. Again, note that the advertising indicia on the outer surface 104 of the first sheet 102 of the article 100 as shown in FIG. 1 is not shown in FIG. 8.

FIG. 9 is a view showing a beverage bottle 200 positioned standing on the article 100 of FIGS. 1-2 in the form of a coaster 100*a* as in FIG. 8. Again, note that the advertising indicia on the outer surface 104 of the first sheet 102 of the article 100 as shown in FIG. 1 is not shown in FIG. 9.

A test was made with the system of the article in the form of a sleeve 100*s* and another article in the form of a coaster 100*a* with a beverage bottle 200 as illustrated in FIG. 9 relative to a control of a similar beverage bottle without the articles 100*s* and 100*a*. In each case, a full bottle 200 of beer was taken from cold storage at a very cold serving temperature and promptly set up on the surface of a table as illustrated in FIG. 9 or placed on the surface without the articles 100*s* and 100*a*. The temperature of the beer in each beverage bottle was measured with a thermometer. Ten minutes is about the average time a person takes for drinking a beer. After allowing the full bottles to stand undisturbed for 10 minutes, the temperature of the beer in each beverage bottle was again measured with the thermometer. For the beverage bottle 200 with the articles 100*s* and 100*a* as shown in FIG. 9, the temperature of the beer in the bottle remained nearly 5° F. (2.5° C.) colder than the beer in the control with the beverage bottle 200 without the articles 100*s* and 100*a*. It should be understood that a few degrees difference in imbibing temperature can make a big difference to the enjoyment of a beverage.

Figure 10:
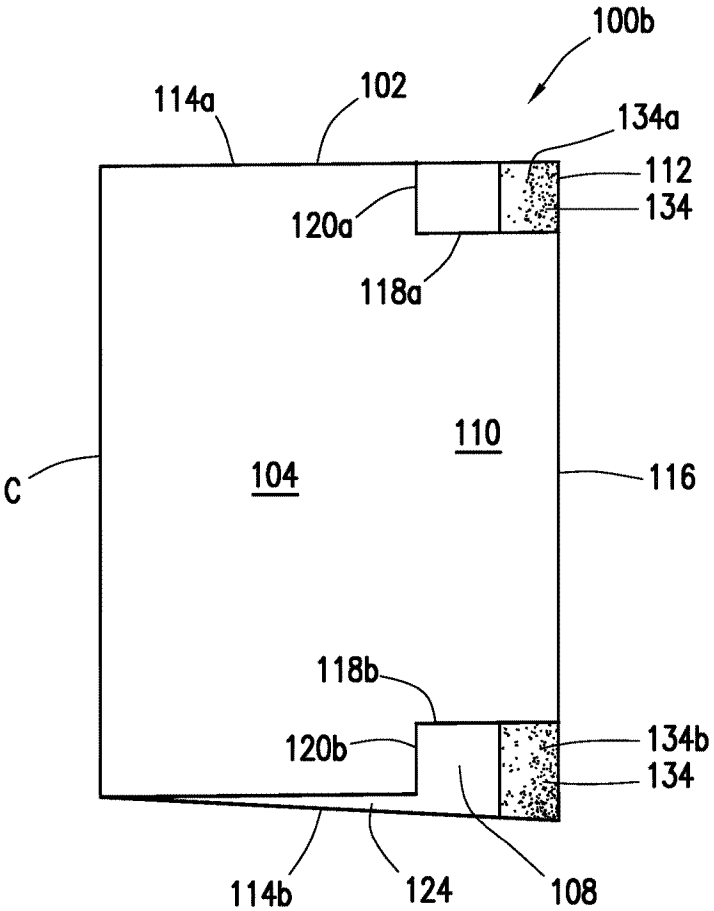
FIG. 10 is a view showing the article of FIGS. 1-3 folded in about in half, that is, about along the article centerline $A_{CL}$, which forms only one center fold crease. In this manner of folding, the exposed second adhesive can be placed downward onto a surface, such as a surface of a table or counter, to adhere the article in this form as a coaster. Again, note that the advertising indicia on the outer surface of the first sheet of the article as shown in FIG. 1 is not shown in FIG. 10.

FIG. 10 is a view showing the article 100 of FIGS. 1-2 folded in about in half that is, about along the article centerline $A_{CL}$, which forms only one center fold crease C, whereby the article is formed as a coaster 100*b*. In this manner of folding, however, the second adhesive 134 on portions 134*a* and 134*b* do not contact the inner surface of the distal end portion 108, and, therefore, do not help keep the first sheet 102 of the article 100*b* from curving or bulging outward from each other (similar to the article as illustrated in FIG. 7). On the other hand, however, the exposed second adhesive 134 on portions 134*a* and 134*b* can be placed downward onto a horizontal surface, such as the surface of a table or counter (not shown in the figure), to adhere the article in this form as a coaster. Optionally, crease C can be indicated by indicia (not shown), such as a line along the centerline $A_{CL}$ of the article 100 on the first sheet 102 (shown in FIG. 1). Optionally, crease C can be pre-scored into first sheet 102 to help with folding the article 100 into the form of a coaster 100*b*. For use of the article 100*b* in this manner and coaster form, the second adhesive 134 is preferably a slightly tacky, pressure-sensitive adhesive. Again, note that the advertising indicia on the outer surface 104 of the first sheet 102 of the article 100 as shown in FIG. 1 is not shown in FIG. 10.

Figure 11:
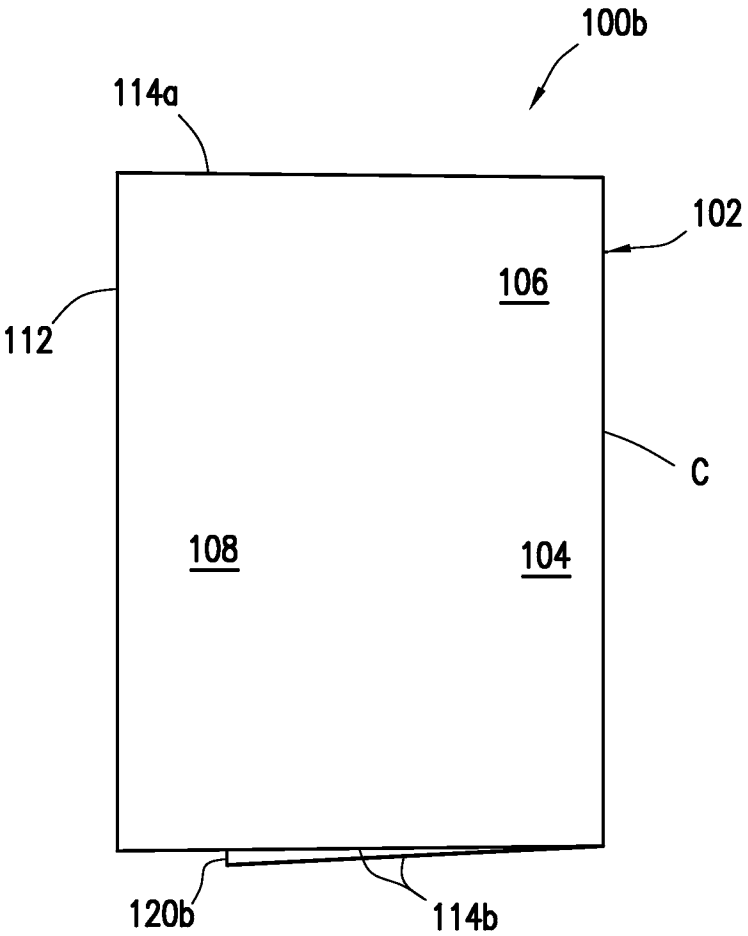
FIG. 11 is a view showing the article folded as in FIG. 10, for use as a coaster, but with the other, less-attractive side placed downward on a table or other horizontal surface, whereby the exposed second adhesive contacts the surface to adhere the article in this form as a coaster. Again, note that the advertising indicia on the outer surface of the first sheet of the article as shown in FIG. 1 is not shown in FIG. 11.

FIG. 11 is a view showing the article 100*b* as in FIG. 10, for use as a coaster, but the other, less-attractive side, which would be normally placed downward on a table or other surface. In this position, the exposed second adhesive 134 on portions 134*a* and 134*b* (none of which are visible in FIG. 11) are placed downward onto a horizontal surface, such as a surface of a table or counter (not shown), to adhere the article 100*b* is in this form for use as a coaster. Again, note that the advertising indicia on the outer surface 104 of the first sheet 102 of the article 100 as shown in FIG. 1 is not shown in FIG. 11.

Figure 12:
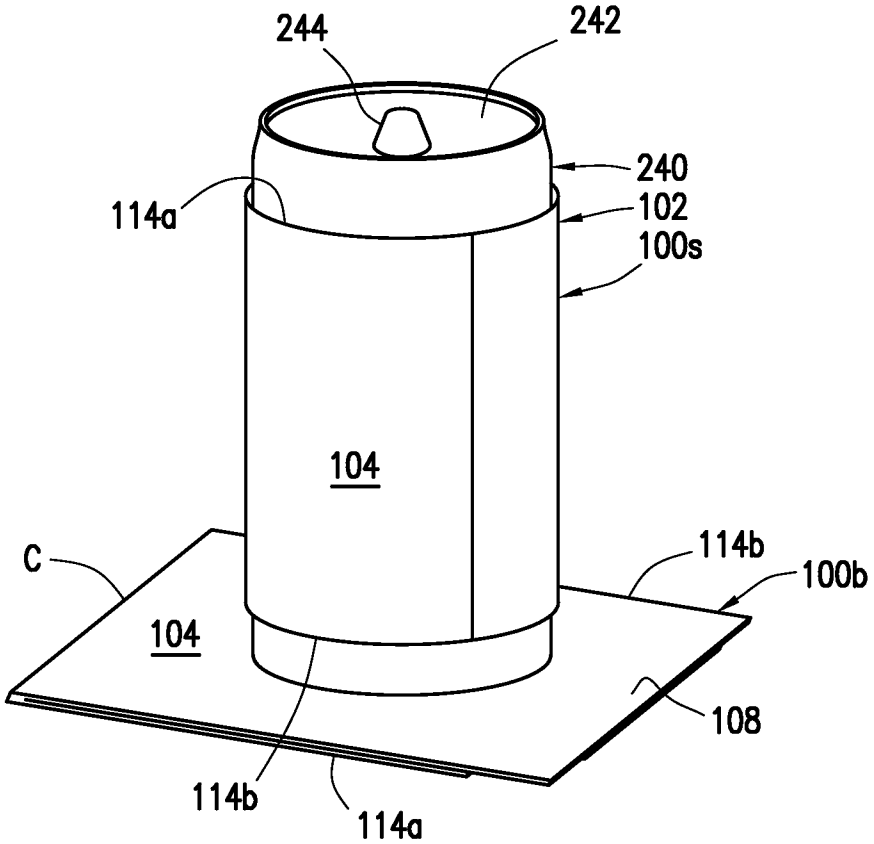
FIG. 12 is a view of a beverage container, such as a beverage can, positioned on top of the article folded in half to form a coaster as in FIG. 11. Again, note that the advertising indicia on the outer surface of the first sheet of the article as shown in FIG. 1 is not shown in FIG. 12.

FIG. 12 is a view of a beverage can 240 positioned on top of the article 100*b* folded in about half and in the form of a coaster as in FIG. 11. Again, note that the advertising indicia on the outer surface 104 of the first sheet 102 of the article 100 as shown in FIG. 1 is not shown in FIG. 12.

FIGS. 13A-B illustrate a "simple" dispenser 300 adapted for stacking, storing, and conveniently dispensing a stacked plurality of the articles 100 in the flat, unused position of FIGS. 1-2. The dispenser 300 includes a bottom wall 302, a back vertical wall 304, a first side vertical wall 306, a second side vertical wall 308, and a front vertical wall 310. An opening 310*a* is formed in the front vertical wall 310. In this embodiment, the dispenser 300 has an open top. In addition, the dispenser 300 optionally has angled exterior corners 312 between the adjacent vertical walls. The walls of the dispenser 300 can optionally be transparent, translucent, or opaque of any color or colors. In addition, the walls of the dispenser 300 can optionally have any kind of indicia (not shown) printed, embossed, or otherwise placed thereon. In FIG. 13A, the dispenser 300 is shown empty. In FIG. 13B, the dispenser 300 is shown containing a stack of a plurality of articles 100 of FIGS. 1-2.

FIGS. 14A-B illustrate a "custom" dispenser 350 adapted for stacking, storing, and conveniently dispensing the articles of FIGS. 1-3, similar to the "simple" dispenser 300 of FIGS. 13A-B, except having blocking vertical wall portions 352 and 354 specially shaped and located to conform with the tab portion 110 of the articles 100 when in a flat, unused position as in FIGS. 1-2, and, thereby, more neatly retaining a stacked plurality of the articles 100.

In addition, the dispenser 300 or dispenser 350 can optionally have another opening 304*a* as shown only in FIGS. 14A-B in the back vertical wall portion 304, which would allow access for dispensing the articles 100 from either the front or the back of the dispenser. In FIG. 14A, the dispenser 350 is shown empty. In FIG. 14B, the dispenser 350 is shown containing a stack of a plurality of articles of FIGS. 1-2.

Figure 15:
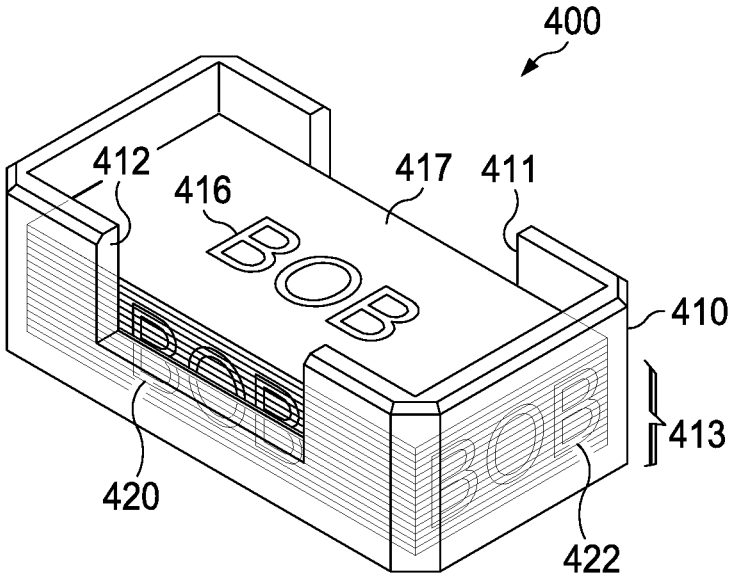
FIG. 15 shows a preferred embodiment of a display system.

Referring then to FIG. 15 dispenser system 400 is described.

Dispenser system 400 includes transparent dispenser 410 with openings 411 and 412. In a preferred embodiment, the dispenser is formed of Plexiglas. The dispenser includes a stack of articles 413 such as those shown in FIGS. 1-3. Articles 413 each comprise a printed indicia 416 on an upward facing surface 417. Stack of articles 413 further comprises a second printed indicia 420. In a preferred embodiment, an edge of each of the articles includes a portion of a larger printed indicia which, when assembled in stack 413, comprises second printed indicia 420. Printed indicia 420 can be seen through the transparent material of dispenser 410. Other printed indicia 422 can also be seen through the transparent material of dispenser 410. In a preferred embodiment, each side of stack 413 may include printed indicia (not shown) which can be seen through the transparent material of dispenser 410.

Therefore, the present disclosure is well adapted to attain the ends and advantages mentioned as well as those that are inherent therein.

The particular embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure.

The various elements or steps according to the disclosed elements or steps can be combined advantageously or practiced together in various combinations or sub-combinations of elements or sequences of steps to increase the efficiency and benefits that can be obtained from the disclosure.

It will be appreciated that one or more of the above embodiments may be combined with one or more of the other embodiments, unless explicitly stated otherwise.

The illustrative disclosure can be practiced in the absence of any element or step that is not specifically disclosed or claimed.

Furthermore, no limitations are intended to the details of construction, composition, design, or steps herein shown, other than as described in the claims.

The invention claimed is:

1. A method for forming an insulator sleeve for a generally cylindrical body from a flat body, wherein the flat body comprises a tab portion, an end portion adjacent the tab portion, an inner surface, an outer surface, a first vertically oriented crease, a second vertically oriented crease, a first adhesive section on the end portion, and a second adhesive section on the end portion, comprising:

positioning the flat body adjacent the cylindrical body;

wrapping the tab portion around the cylindrical body;

wrapping the end portion around the cylindrical body to meet the tab portion;

adhering the end portion to the tab portion via the first adhesive section thereby forming an overlapping portion;

removing the flat body from the cylindrical body;

folding the flat body along one of the first vertically oriented crease and the second vertically oriented crease;

adhering the second adhesive section to the inner surface of the flat body when the flat body is folded along the first vertically oriented crease;

adhering the second adhesive section to a generally horizontal surface when the flat body is folded along the second vertically oriented crease.

2. The method of claim 1 further comprising:

removing a protective film from contact with the first adhesive section.

3. The method of claim 1 wherein the flat body further comprises a first edge adjacent the tab portion and the end portion further comprises a second edge, the method further comprising the step of:

generally aligning the first edge with the second edge.

4. The method of claim 1 wherein the end portion has the second adhesive section, further comprising:

adhering the end portion to the cylindrical body with the second adhesive section.

5. The method of claim 1 wherein the flat body has a set of linearly aligned vertical edges adjacent the tab portion, and the second adhesive section on the end portion adjacent the set of vertical edges, further comprising:

aligning the end portion with the set of vertical edges; and, adhering the end portion to the cylindrical body with the second adhesive section.

6. The method of claim 1 wherein the flat body comprises a major portion between the end portion and the tab portion and wherein an absorbent layer is attached to the major portion, further comprising:

positioning the absorbent layer between the flat body and the cylindrical body.

7. The method of claim 1, further comprising:

positioning the inner surface adjacent the cylindrical body; and, positioning the outer surface adjacent the inner surface.

8. The method of claim 1 wherein a set of advertising indicia are printed on an outer surface of the flat body, further comprising:

positioning the flat body on the cylindrical body so as to expose the set of advertising indicia.

9. A method for forming a coaster from a flat body, wherein the flat body has an inner surface and an outer surface, a tab portion having a first edge, and end portion having a second edge, a first adhesive section and a second adhesive section both on the end portion, and a major portion between the tab portion and the end portion, comprising:

generally aligning the first edge with the second edge;

folding the flat body through the major portion along one of a first vertically oriented crease and a second vertically oriented crease;

adhering the inner surface to the end portion with the first adhesive section;

adhering the second adhesive section to the inner surface when the flat body is folded along the first vertically oriented crease; and, adhering the second adhesive section to a generally horizontal surface when the flat body is folded along the second vertically oriented crease.

10. The method of claim 9 wherein the end portion has the second adhesive section, and further comprising:

adhering the end portion to a generally cylindrical body with the second adhesive section.

11. The method of claim 9, wherein the first adhesive section further comprises a flexible protective film and the method further comprises:

removing the film from the first adhesive section.

12. The method of claim 9 wherein the major portion further comprises a midpoint and the step of folding the second vertically oriented crease further comprises:

folding the flat body along the second vertically oriented crease at the midpoint.

13. The method of claim 9 wherein the coaster is contained in a dispenser and the method further comprises:

removing the flat body from the dispenser.

* * * * *